US008290193B2

(12) United States Patent
Pang et al.

(10) Patent No.: US 8,290,193 B2
(45) Date of Patent: Oct. 16, 2012

(54) HEADPHONES WITH REDUCED TANGLING AND METHODS

(76) Inventors: Jeffrey Pang, Menlo Park, CA (US); Stephen Y. F. Pang, Menlo Park, CA (US); Caroline Pang, Menlo Park, CA (US); David Pang, Menlo Park, CA (US)

( * ) Notice: Subject to any disclaimer, the term of this patent is extended or adjusted under 35 U.S.C. 154(b) by 255 days.

(21) Appl. No.: 12/777,819

(22) Filed: May 11, 2010

(65) Prior Publication Data

US 2011/0110552 A1 May 12, 2011

Related U.S. Application Data

(60) Provisional application No. 61/177,166, filed on May 11, 2009.

(51) Int. Cl.
*H04R 25/00* (2006.01)

(52) U.S. Cl. ..... 381/374; 381/370

(58) Field of Classification Search ..... 381/309, 381/311, 370, 374, 376, 380, 384; 379/430; 439/131; 455/569.1
See application file for complete search history.

(56) References Cited

U.S. PATENT DOCUMENTS

| | | | |
|---|---|---|---|
| 2009/0238395 | A1 | 9/2009 | Jubelirer et al. |
| 2010/0150370 | A1 | 6/2010 | Bales et al. |
| 2011/0317865 | A1 | 12/2011 | Stevinson |

FOREIGN PATENT DOCUMENTS

| | | |
|---|---|---|
| KR | 20-1994-0023766 | 10/1994 |
| KR | 20-1997-011662 | 3/1997 |
| KR | 20-0156024 | 6/1999 |
| KR | 20-0157187 | 6/1999 |
| KR | 20-0181938 | 3/2000 |
| KR | 20-0272819 | 8/2002 |
| KR | 10-2005-0029659 A | 3/2005 |

OTHER PUBLICATIONS

Kim, Hyeon-Jeong, Translation of Korean Publication No. 20-1997-011662 published on Mar. 29, 1997.*
International Search Report for PCT/US2010/034445 filed on May 11, 2010.
Written Opinion of the International Searching Authority for PCT/US2010/034445 filed on May 11, 2010.
Notification of the Transmittal of the International Search Report and the Written Opinion of the International Searching Authority, or the Declaration for PCT/US2010/034445 filed on May 11,2010.
Office Action for U.S. Appl. No. 13/133,842 dated Aug. 17, 2012.

* cited by examiner

*Primary Examiner* — Brian Ensey
(74) *Attorney, Agent, or Firm* — Ogawa P.C.

(57) ABSTRACT

A headphone having reduced tendency to tangle comprises an input portion for receiving electrical signals from an output device, an output portion for providing audio signals to a user in response to the electrical signals, a plurality of wires coupled to the input portion and the output portion for providing the electrical signals to the output portion, and a restraint mechanism coupled to the plurality of wires and cable of being repositioned along the plurality of wire, wherein the restraint mechanism is for physically receiving insertion of at least a portion of the input portion and for physically restraining movement of the portion of input portion with respect to output portion when the portion of the input portion is physically inserted into the restraint mechanism, wherein a temporary and removable closed loop of wire is formed from the plurality of wires, until a sufficient separation force is applied.

35 Claims, 10 Drawing Sheets

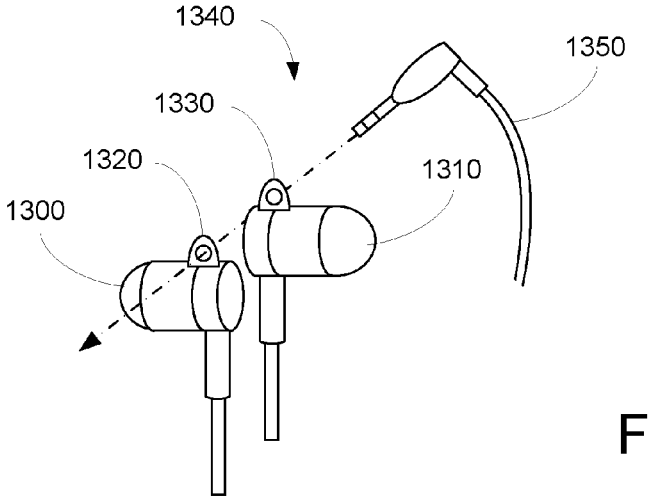
FIG. 4A
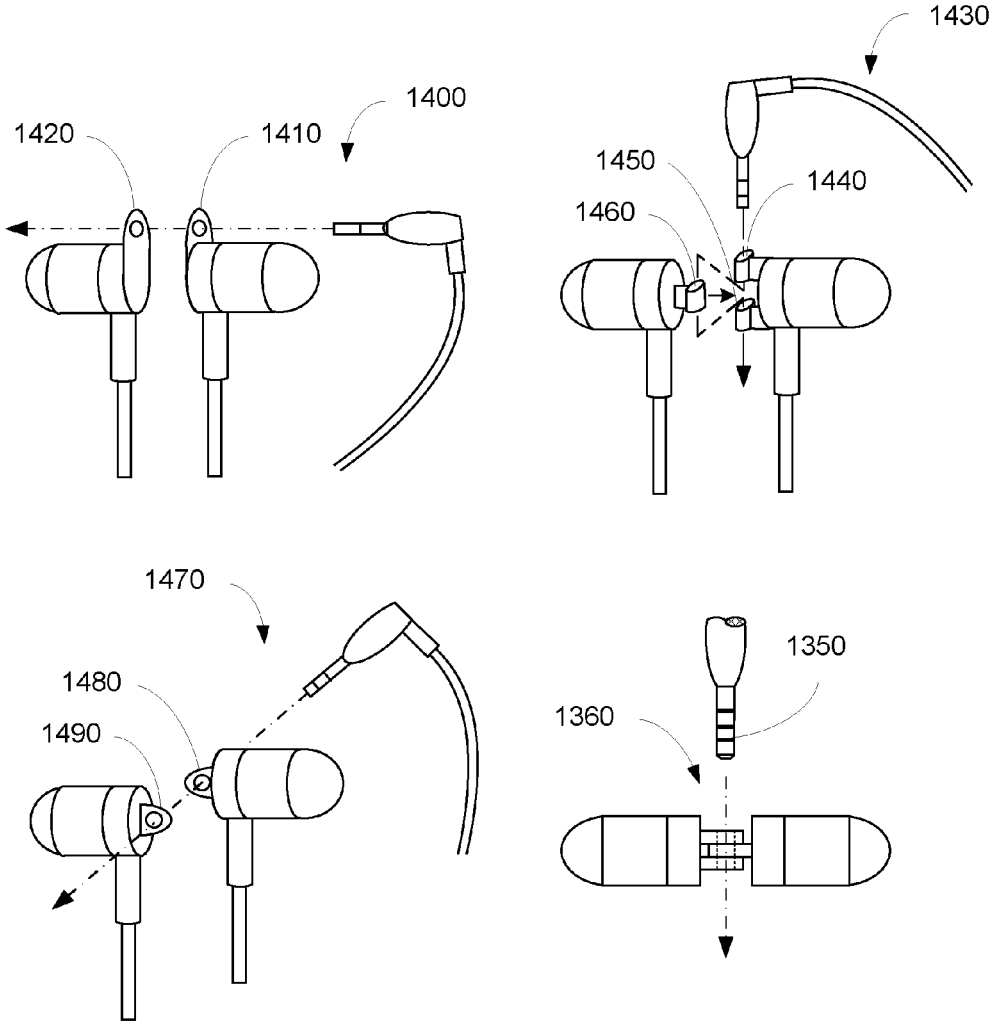
FIG. 4B1

FIG. 4B2

HEADPHONES WITH REDUCED TANGLING AND METHODS

The invention claims priority to and is a non-provisional of U.S. application no. 61/177,166 filed May 11, 2009, titled Head Phone Apparatus and Related Methods. The provisional application is incorporated herein for all purposes.

BACKGROUND OF THE INVENTION

Embodiments of the present invention relate to wired headphones. More specifically, the present invention relates to wired headphones having the ability to be stored in a configuration with reduced tangling tendency and methods thereof.

The inventors of the present invention have had many instances when they removed headphones (e.g. ear bud-type headphones) from a storage location (e.g. a pocket, a backpack), the headphones are tangled in a large mass of wires. In some instances, the inventors have had to spend minutes untangling a headphone cord before they can even use them. Accordingly, the inventors desired a headphone that had a reduced tendency to tangle.

The inventors are aware of some methods used to try to reduce the amount of tangling of headphone wires. One such technique has been to use thicker headphone wires and/or thicker wire insulation. A similar technique has been to use flat ribbon-type headphone wires that have a great deal of stiffness. The inventors believe that thick headphone cords (wires and insulation) are designed to be stiff so that it is difficult for one part of the cord to get tangled with another part of the cord. An example of such a headphone is sold by Monster, Inc. under the brand name "Heartbeats by Lady Gaga."

Drawbacks to such approaches are believed to include that the headphone cords may be so stiff that is makes the headphones uncomfortable for a user to wear. For example, when the user moves a portable music player from their jeans pocket to their shirt pocket, the stiff cables may undesirably curve and protrude into the user's face, protrude out of a jacket, or the like. Additionally, the headphones cannot be discreetly worn. As another drawback, from a manufacturer's point of view, it is believed that increasing the wire thickness, insulation thickness, etc, undesirably drives up the material cost of such headphones.

Another method used has been to provide a "wire pull" similar to a bolo tie between the headphone wires attached to each headphone element (e.g. ear bud). In operation, such a wire pull is used to draw the headphones together before they are stored.

Drawbacks to such approaches are believed to include that tangling of headphones is still a problem. Based upon the inventor's own experience with headphone cords having such a wire pull, the amount of tangling of wires is still quite high. Further, these wire pulls tend to slide-away from the headphones (allowing the headphones to come apart) with the same amount of force as it takes for the user to slide the wire pull up towards the headphones. Accordingly, such wire pulls often slide away from the headphones and thus fail to even keep the ear buds together.

Yet another set of drawbacks includes that some headphones include microphones positioned near the user's mouth, along the length of the headphone wire that interferes with the wire pull. If the wire pull is simply located below the position of the microphone, the ear buds are subject to the same amount of tangling as described above. If the wire pull is located above where the microphones are typically located (by the user's jaw), there is not enough free headphone wire to reach the user's ears. Further, if the wire pull is designed to be attached and detached from one of the headphone wires every time the headphones are to be stored, it would require patience and skill for the user just to store the headphones.

Another method used has been to provide a winding mechanism for the headphone cords that include an automatic retraction mechanism. In operation, a user would retract the amount of headphone wire they desired from the spool and use the headphones. Subsequently when the user is finished, the spool can automatically retract the headphone cords (e.g. similar to roller blinds). In various examples the inventor has reviewed, the headphone wires are held in a "S" position within a central spool. To wind up the headphone cord, the spring-loaded spool is automatically turned in the counter-clock-wise direction to take-up the headphone cord; and to unwind the headphone cord, the ear buds and the input jacks are pulled by the user, causing the spool of wire to turn in the clock-wise direction, for example Drawbacks to such techniques include that the headphone wire within the spooling mechanism is often placed under great repetitive stresses, is often stored in very stressful positions. For example, when in the stored position, the top and bottom wires portions of the "S"-shaped wire tend to be tightly pressed and bent in a 90 degree angle against the spool. These sharp wire bends potentially cause damage to the wire. As another example, when in the stored position, the ear buds and the audio input jack tend to be tightly pressed against the case of the wire spool. Further, as the user typically grips the ear buds and audio input jack and pulls to unwind the wire, this additional stress can potentially cause the wire connecting the ear buds or the input jack to break.

Yet another drawback is that such spooling mechanisms are bulky and unattractive. For example, some spooling mechanisms are bulky and when the user turns her head, the inertia of the spooling mechanism will cause the headphone cables to swing around, and pull an ear bud out from the user's ears. Additional drawbacks include that such spooling mechanisms are sometimes over an inch in diameter and a quarter inch in thickness. Accordingly, when the headphones are in use, the large spool unattractively sits prominently in the middle of the user's chest.

Another method used has been to provide a manual winding mechanism for allowing the user to manually winding the headphone wire around an object. One such example is a headphone case that has a dial-type mechanism. In operation, when the user desires to store their headphones, the user carefully places each ear bud into the earphone case, then the user dials (e.g. rewinds) the headphone wire within the headphone case, until the input jack is reached.

Drawbacks to such an approach include that it requires the user to keep their headphones in a bulky storage case until they are ready to use their headphones, As users tend to want to travel "light," it is believed that carrying such an external storage case is highly undesirable. Further, similar to the drawbacks described above, such methods tend to generate great stress in the wires attached to the ear buds and/or in the input jack, and/or with repeated winding, the headphone wires are constantly subject to wire stretching. These types of stresses both lead to premature wire breakage. Additionally, such approaches require the user to waste time on a time consuming wind and unwind "routine" every time the user wants to use their headphones.

Still another method, not necessarily in the prior art, is the use of a piece of plastic shaped in a fish bone, dog bone or donut, or the like for winding the headphones. In operation, it appears the audio input jack is placed into a "tail" of the fish, the headphone wires are wound around the "bones," and after the winding is complete, the ear buds are secured within the "eye" of the fish.

Drawbacks to such methods are believed to be even more significant than the ones described above. For example, each time the headphone wire is wound around the fish, the headphone cords are bent in a very sharp 180 degree angle. As this is repeated for the length of the headphone wire, very many places of the headphone wire are subject to pre-mature wire fatigue and breaking. Other drawbacks include that the input jack and/or the ear buds are repeatedly drawn tightly within the "tail" or the "eye" of the fish as the user winds the headphone wire. This may undesirably cause a break in the wire near or within the input jack and/or the ear buds. Additionally, in general, it is believed that anytime the headphone wire is wound around an object, the wires are stretched. With repeated use, the constantly stretched wires tend to prematurely break. Further, as described above, this winding and unwinding routine is very time consuming.

Yet another method has been for the user to wind the headphone cords around their fingers in a "bull horn" fashion, and to give a final tight transverse wind with the cord to secure the previously wound portion.

Drawbacks to such methods include that the winding process is very time consuming to perform when packing up their headphones. Another drawback is that it is very time consuming for a user to unwind the wires when they want to listen to music or talk on a phone. Additionally, the techniques require great discipline for the user to maintain such a routine. Yet another drawback, as discussed in the techniques above, includes that it tends to place great stress upon the headphone wires. For example, the headphone wire that is used to perform the final transverse wind is subject to a lot of stretching and stress as the user attempts to generate a nice tight wind (so the wire does not inadvertently unwind in a user's backpack, for example). Accordingly, it is believed that such repetitive stresses tend to greatly reduce the lifespan of headphones.

The problems described above for the various methods for reducing headphone tangling are magnified when the headphones include a microphone, e.g. a telephone headset. In such cases, the user must be able to quickly retrieve their headphones and answer their telephones. However, using such techniques, when answering a telephone call in a hands-free configuration, the user cannot stop to unwind, unspool, or untangle their headphone wires and cannot divert her attention from driving to do so, even at a stop light. Further, after completing such calls, if the user is driving, for example, the user also does not have time and cannot devote her attention to meticulously re-winding their headphones back into their cases. Instead, it is believed that in most cases the wires are simply dropped into a heap, waiting to be manually untangled later. Of course other current methods for conducting hands-free telephone calls are known, such as Bluetooth earpieces, and speakerphones, however, each of these have their drawbacks (e.g. RF radiation next to the brain, losing the Bluetooth earpiece, suppressing external noise, etc.).

From the above, it is seen that a headphone having reduced tangling is desired without the drawbacks described above.

BRIEF SUMMARY OF THE INVENTION

Embodiments of the present invention relate to wired headphones. More specifically, the present invention relates to wired headphones having the ability to be stored in a reduced-tangling tendency configuration and methods thereof.

Various embodiments of the present invention include a headphone including one or more ear buds, an audio input jack, and a restraining mechanism, as described herein. The restraining mechanism is adapted to restrain movement of the one or more ear buds relative to the audio input jack, thereby forming a temporary removable loop in the headphone wires. In various embodiments, the restraining mechanism is adapted to maintain the temporary loop in the headphone wires but can release the temporary loop in the headphone wires upon application of a relatively low amount of force, e.g. several pounds.

In various embodiments, the restraining mechanism may be incorporated into wire pulls of headphones. In such examples, pathway restraints are provided for right and left headphone wires, and a wire pull may include a pathway restraint for the audio input jack. In various embodiments, the wire pull may include a single pathway for the right and left headphone wire as well as the audio input jack; the wire pull may include two pathways: for the right and left headphone wires, and for the audio input jack; the wire pull may include three pathways: for the right headphone wire, for the left headphone wire, and for the audio input jack; and the like. In various embodiments, the pathways may be enclosed holes within a material; holes with slots in the material for inserting and removing wires, for example; semi-circular slots, grooves, or openings in the material; and the like. Additionally, in various embodiments, the restraining mechanism may be made of a pliable material, such as silicone, rubber, plastic, wire, or the like.

In operation, after the user removes her headphones, she grasps the wire pull in one hand and the audio input jack in the other hand. Then she repositions the wire slide towards the ear buds, and then inserts the audio input jack into the groove, slot, or hole of wire pull, thereby creating a temporary loop of wire. In various embodiments, a sliding resistance of the wires with respect to the wire pull is increased when the audio input jack is inserted into the wire pull.

In other embodiments, the restraining mechanism may be incorporated into the ear bud portions of the headphones. In some examples, one ear bud may include a restraining mechanism that can restrain movement of the audio input jack. The restrained audio input jack in turn restrains movement of the other ear bud. In various embodiments, the restraining mechanism may include a hole (e.g. internal sleeve) or groove manufactured into the casing of one of the ear buds having an inside diameter or width slightly smaller to the diameter of the audio input jack, and a loop of wire attached to the casing or hole in the casing of the other ear bud having an inside diameter or width larger than the diameter of the audio input jack.

In operation, after the user takes-off his headphones, he inserts the audio input jack into the larger hole, loop of wire, etc. of the second ear bud, and then inserts the audio input jack into the hole, groove, loop of wire, etc. of the first ear bud thereby creating the temporary loop of wire. Since the diameter of the groove, hole, etc. is smaller than the audio input jack, it is contemplated some level of force is required to break the temporary loop of wire, i.e. remove the audio input jack from the ear buds.

In other examples, each ear bud includes a restraining mechanism that can restrain movement of the audio input jack. In various embodiments, the restraining mechanism may include a hole or groove manufactured into the casing of the ear buds having an inside diameter or width slightly smaller to the diameter of the audio input jack. In other embodiments, the restraining mechanism may include one or more loops of wire attached to or manufactured into the casing of the ear buds. Similar to the above, the diameter or width may be smaller than the audio input jack. In operation, after the user takes-off his headphones, he inserts the audio input jack into the holes, grooves, loops of wires, etc. of the ear buds thereby creating the temporary loop of wire. Since the diameter of such structures is smaller than the audio input jack, it is contemplated some level of force is required to break the temporary loop of wire, i.e. remove the audio input jack from the ear buds.

In other embodiments, a restraint mechanism may be incorporated into the casing of the audio input device (e.g. plug housing). In such examples, the audio input device may include one or more grooves, slotted holes, wire loops, etc. as part of the manufactured casing or attached thereafter. In various embodiments, the grooves, slotted holes, etc. are adapted to restrain the ear buds with respect to the audio input device. In operation, after a user takes off his headphones, he snaps or otherwise secures each ear bud into one or more holes, slots, grooves, etc. of the audio input device, thereby creating the temporary loop of wire.

According to one aspect of the invention, an apparatus is disclosed including an audio input portion, an audio output portion coupled to the audio input portion via a wire, and a restraining means coupled to the wire, for restraining the audio input portion relative to the audio output portion, and for creating a temporary loop in the wire.

According to another aspect of the invention, an apparatus is disclosed including at least one audio input jack, a pair of earphones coupled to the audio input jack via a pair of wires, and a wire pull coupled to the pair of wires. The wire pull is configured to be repositioned along the pair of wires, and is configured to be positioned adjacent to the pair of earphones on the wire. The wire pull is configured to restrain the audio input jack thereby forming a temporary loop in the pair of wires, and is configured to restrain the pair of wires when the audio input jack is restrained.

According to another aspect of the invention, an apparatus is disclosed including at least one audio input jack, a pair of earphones coupled to the audio input jack via wires. The audio input jack includes restraining mechanisms adapted to restrain the movement of the earphones relative to the audio input jack, thereby forming a temporary loop in the wires.

According to another aspect of the invention, a method for a pair of headphones including at least one ear bud coupled via wires to an audio input jack is disclosed. In one process the user removes the at least one ear bud from her ear, and removes the audio input jack from an audio device. In one process, a user grasps a restraint device with a first hand and repositions the restraint device in a location proximate to the one ear bud, and the user grasps the audio input jack with a second hand. In one process, the user couples a portion of the audio input jack to the restraint device thereby restraining movement of the at least one ear bud relative to the audio input jack, and thereby forming a temporary loop in the wires.

According to another aspect of the invention, a method for a pair of headphones including at least one ear bud coupled via wires to an audio input jack is disclosed. In one process, the user retrieves the pair of headphones stored in a first configuration, from a storage location, wherein the first configuration comprises the audio input jack being physically coupled to the at least one ear bud by a restraint mechanism such that movement of the audio input jack is restrained with respect to movement of the at least one ear bud, and wherein a loop is formed by the wires. A process may include the user visually identifying the audio input jack and the restraint mechanism, grasping the audio input jack with one hand, and pulling the audio input jack from the restraint mechanism. Various processes may include the user inserting the audio input jack into an audio device and placing the at least one ear bud in a position proximate to a location of the user's ears.

According to one aspect of the invention, a method for storing headphones having a plurality of ear buds and an audio plug coupled via a pair of wires com and a restraining mechanism is disclosed. One technique includes grasping the restraining mechanism with one hand of a user, grasping the audio plug with the other hand of the user, and positioning the restraining mechanism to a position proximate to the plurality of ear buds with the one hand. A process may include physically coupling the audio plug with the restraining mechanism thereby positioning the audio plug adjacent to the plurality of ear buds and thereby forming a temporary and removable closed loop of wire from the pair of wires. A step may include restraining with the restraining mechanism, until a sufficient separation force is applied, movement of the audio plug with respect to the plurality of ear buds.

According to another aspect of the invention, a headphone having reduced tendency to tangle is disclosed. One apparatus includes an audio input portion configured to receive a plurality of electrical audio signals from an audio output device, an audio output portion configured to provide audible output audio signals to a user in response to the plurality of electrical audio signals, and a plurality of wires coupled to the audio input portion and the audio output portion, wherein the plurality of wires are configured to provide the electrical audio signals to the audio output portion. A device may include a restraint mechanism coupled to the plurality of wires, wherein the restraint mechanism is configured to be positioned at a plurality of positions along the plurality of wire, wherein the restraint mechanism is configured to physically receive insertion of at least a portion of the audio input portion, wherein the restraint mechanism is configured to physically restrain movement of the portion of audio input portion with respect to the plurality of ear buds when the portion of the audio input portion is physically inserted into the restraint mechanism thereby forming a temporary and removable closed loop of wire from the plurality of wires, until a sufficient separation force is applied.

According to yet another aspect of the invention, a pair of headphones is disclosed. One system includes an audio input jack configured to receive electrical audio signals, a pair of ear buds configured to output audible audio signals in response to the electrical audio signals, and a pair of wires configured to electrically and physically couple the audio input jack to the pair of ear buds. A device may also include restraining means configured to restrain the audio input jack adjacent to the pair of ear buds and configured to restrain movement of the audio input jack relative to the pair of ear buds when the audio input jack and the pair of ear buds are placed in a first configuration with respect to the restraining means, by the user and wherein when in the first configuration, a temporary and removable loop of wire is formed from the pair of wires, and configured to not appreciably restrain the audio input jack adjacent to the pair of ear buds and configured to not appreciably restrain movement of the audio input jack relative to the pair of ear buds when the audio input jack and the pair of ear buds are placed in a second configuration with respect to the restraining means, by the user, and wherein when in the second configuration, the temporary and removable loop of wire is not formed from the pair of wires.

According to yet another aspect of the invention, instead of a pair of headphones, embodiments may be applied to any type of consumer electronic device, such as a mouse, a corded device, a transformer, or the like. In various embodiments, in addition to forming a temporary loop of wire in such devices, the insertion of one portion into another portion may also provide additional benefits, such as disconnecting power supplied to a transformer, or the like.

Various additional objects, features and advantages of the present invention can be more fully appreciated with reference to the detailed description and accompanying drawings that follow

BRIEF DESCRIPTION OF THE DRAWINGS

In order to more fully understand the present invention, reference is made to the accompanying drawings. Understanding that these drawings are not to be considered limitations in the scope of the invention, the presently described embodiments and the presently understood best mode of the invention are described with additional detail through use of the accompanying drawings in which:

FIGS. 4A-G illustrate additional embodiments of the present invention.

DETAILED DESCRIPTION OF THE INVENTION

Figure 1A:
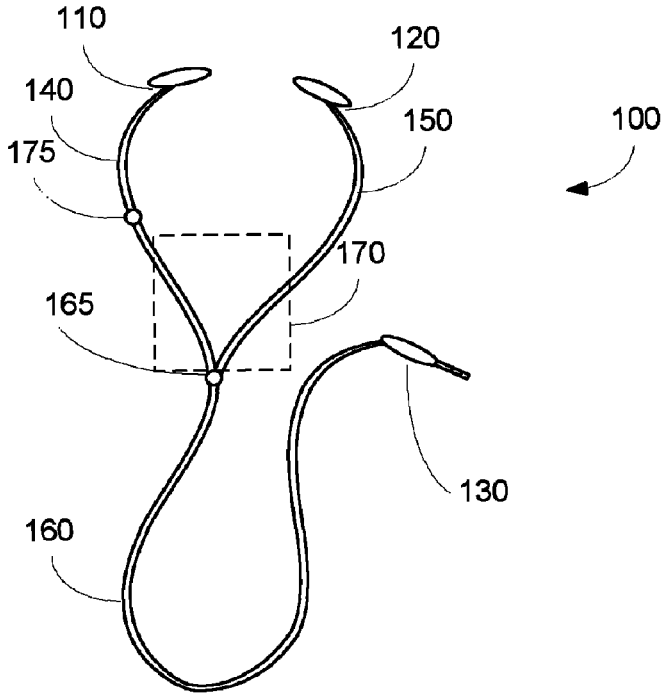
FIGS. 1A-B illustrate typical embodiments of the present invention.

FIG. 1A illustrates one embodiment of the present invention embodied with a typical headphone 100. In FIG. 1A, headphone 100 includes a plurality of analog audio output portions 110 and 120. These are commonly termed ear buds, ear phones, or the like. Output portions 110 and 120 typically convert electrical audio input signals into analog audio output signals which are then output to a user's ears. Other embodiments of the present invention may include a single output portion 110.

Headphone 100 also typically includes an electrical audio input portion (jack) 130. Various examples of this include standard 3.3 mm, 2.5 mm audio connectors or plugs. In other embodiments, electrical audio input portion 130 may include three electrical inputs (e.g. ground, left output, right output), four electrical inputs (e.g. ground, left output, right output, microphone input), or the like. In other examples, other types of connectors for headphone 100 are contemplated, such as ¼ inch phono connectors, USB, connectors compatible with proprietary devices, such as the Apple iPod or iPad series of devices, and the like.

In various examples, output portions 110 and 120 are physically coupled to input portion 130 via a pair of insulated wires 140 and 150. Typically wires 140 and 150 provide respective electrical audio signals from input portion 130 to output portions 110 and 120 (e.g. left output, right output).

In various embodiments, wires 140 and 150 may be physically adjacent for a portion 160 of their length. A divider 165 may be use to limit the length that wires 140 and 150 are not adjacent. In some embodiments, divider 165 may be made of plastic and/or metal, and in other embodiments, divider 165 may not be present. In various embodiments, a microphone input may be located along wire 140, as shown, or the like.

In the embodiment illustrated, a restraint element 170 may be positioned anywhere along wire 140 and/or wire 150. In other embodiments, restraint element 170 may be part of, adjacent to, or near output portions 110 and/or output portions 120. In other embodiments, restraint element 170 may be part of, adjacent to, or near input portion 130. FIG. 1A illustrates a first configuration of restraint element 170 being located near divider 165.

Figure 1B:
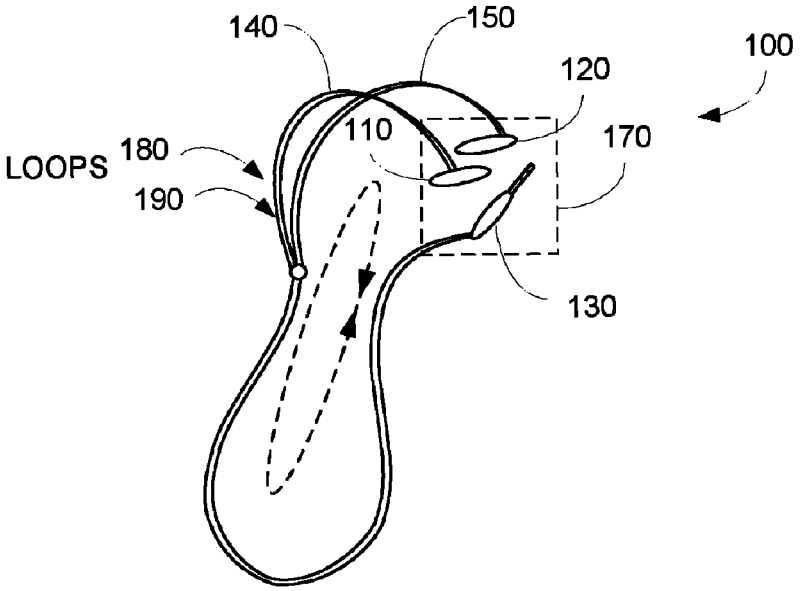

FIG. 1B illustrates another embodiment of the present invention. More specifically, in the embodiment illustrated in FIG. 1B, restraint element 170 is used to physically restrain the movement of output portions 110 and 120 with respect to input portion 130, and with respect to each other. In various embodiments, restraint element 170 causes one or more temporary wire loops 180 and 190 to be formed in wires 140, 150 and 160. In various embodiments, these one or more temporary wire loops may be referred to as a single wire loop for sake of convenience.

In various embodiments of the present invention, the loop should be temporary in nature so as to reduce the choking hazard or choking potential to the user or other persons. As will be discussed below, various embodiments of restraint element 170 "somewhat" restrains movement of output portions 110 and 120 with respect to input portion 130, meaning that loop is temporary in nature. This is until the user applies sufficient (e.g. maximum required) separation force upon input portion 130, for example. In various embodiments, an application of a separation force (e.g. 1 pound, 2 pounds, 3 to 5 pounds, etc.) applied by a user pulling apart input portion 130 from restraint element 170 or output portions 110 and 120 may cause temporary wire loop 180 to disappear. This relatively low (maximum required) separation force in some embodiments provides a higher level of safety compared to other embodiments that may require a higher separation force, e.g. 10 pounds. A minimum separation force should, however, be sufficient to reduce the incidence of the input portion 130 becoming separated from output portion 130 because of incidental movement of headphones 100 in a user's pocket or backpack, for example. In various examples, a minimum separation force may be, for example, 0.5 pounds, 1 pound, 2 pounds or the like. In various embodiments, the minimum separation force, as well as the maximum required separation force may be varied according to engineering preference and other safety concerns.

Further, in various embodiments, "restrains movement" may mean restricting the amount of movement of the portions physically restrained using the restraint element. For example, in various embodiments, the amount of movement allowed may be less than one-half an inch, one-quarter an inch, one-tenth an inch, five mm, four mm, three mm, two mm, one mm, or even no movement, in any direction or in the direction towards and/or away from the separation force. Restricting the amount of movement is believed to help reduce the tangling potential of the wired headphone.

In various embodiments of the present invention, the restraining force provided by restraint device 170 may be directly or nearly directly opposite of the direction of an applied separation force between output portions 110 and 120 and input portion 130. Such embodiments may provide higher reliability or repeatability for safely releasing the temporary loop of wire when the separation force is applied. Further, such embodiments would allow the release of the temporary loop of wire without damaging output portions 110 or 120, and/or input portion 130. In other embodiments, the restraining force provided by restraint device 170 may be transverse or skew to the direction of an applied separation force between output portions 110 and 120 and input portion 130. In such embodiments, the output portions 110 or 120, and/or input portion 130 should also be configured such that the temporary loop of wire may be released without damaging output portions 110 or 120, and/or input portion 130.

In various embodiments of the present invention, as will be illustrated below, restraint element 170 may include one or more components and may be integrally formed as part of output portion 110, output portion 120, and/or input portion 130. In other embodiments, restraining element 170 may be normally physically attached to any one of output portion 110, output portion 120, and/or input portion 130. In other embodiments, restraint element 170 may be positioned along wires 140, 150, and/or portion 160. In various embodiments, restraint element 170 may be able to slide or move with along wires 140, 150 and/or portion 160, and in other embodiments, restraint element 170 may be affixed to a specific portion of the respective wires. In still other embodiments, restraint element 170 may be provided separately from headphones 100, and may still be used by a user in the manner described herein. Various embodiments will be illustrated, below FIGS. 2A-I illustrate various embodiments of the present invention. More specifically, FIGS. 2A-I illustrate embodiments where a portion of restraint element may be able to slide or move along wires that are coupled to ear buds and may restrain the audio input portion.

Figure 2A:
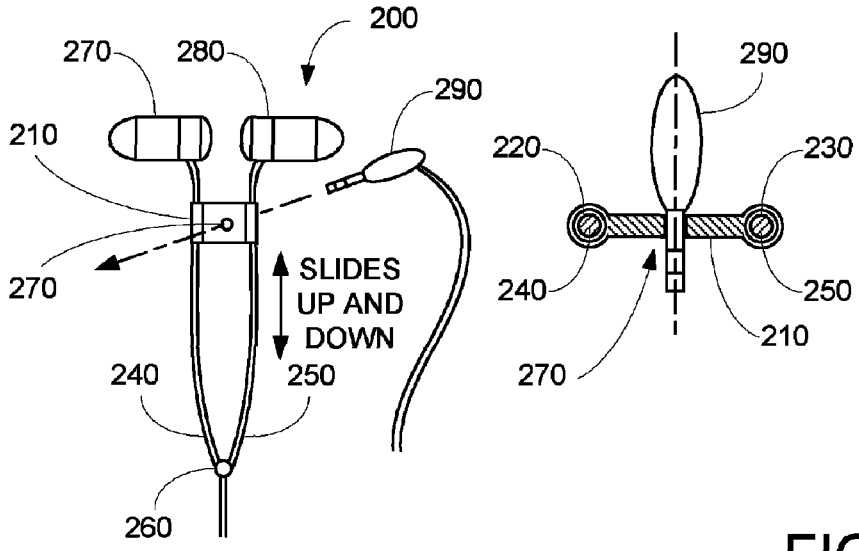
FIGS. 2A-I illustrate additional embodiments of the present invention.

In the example in FIG. 2A, a headphone 200 includes a restraint element 210 that is movable along wires 240 and 250 that are coupled to ear buds 270 and 280. In this embodiment, restraint element 210 includes a pathway 220 and a pathway 230. In various embodiments, pathway 220 and/or pathway 230 may be enclosed pathways, e.g. holes, such that wires 240 and/or 250 cannot be removed from restraint element. In other embodiments, first and/or pathways 220 and 230 may have openings, e.g. slots, such that wires 240 and/or 250 may be removed from restraint element 210.

In various embodiments, restraint element 210 can be repositioned along first and second wires 240 and 250. For example, in a first configuration, restraint element 210 may be positioned near divider 260. In such a configuration, first wire 240 and second 250 are typically long enough to enable the user to place ear bud 270 and/or ear bud 280 into her ears.

In a second configuration, restraint element 210 may be repositioned near ear bud 270 and ear bud 280 by a user. In various embodiments, it is contemplated that any inherent resistance between first wire 240 and pathway 220, and resistance between second wire 250 and pathway 230 should be high enough to somewhat restrain the ear buds in the second configuration. Accordingly, restraint element 210 restrains the position of ear bud 270 with respect to ear bud 280.

In some embodiments, the amount of resistance between restraint element 210 with respect to wires 240 and 250 may not be set too high. For example, it is contemplated that the resistance should be low enough such that if restraint element 210 is positioned in the second configuration and the user pulls ear bud 270 away from ear bud 280, she will be able to easily separate the ear buds. It is contemplated that this separation action causes restraint element 170 to slide towards divider 260 with respect to at least one of the wires.

In various embodiments illustrated in FIG. 2A, restraint element 210 includes a pathway 270. In various embodiments, as will be illustrated below, pathway 270 may be a hole within restraint element 210, an open path (e.g. slightly larger than semicircular groove), or the like. In various embodiments, pathway 270 may be a hole or a partial hole (e.g. groove) having a diameter, width, or the like that is slightly smaller than the diameter of audio input portion 290. In operation, as illustrated in FIG. 2A, audio input portion 290 may be inserted by the user into pathway 270.

In FIG. 2A, restraint element 210 may be formed from a single piece of material for sake of simplicity. However, in other embodiments of the present invention, restraint element 210 may be formed from two or more elements that cooperate to somewhat restrain movement of input portion 290 from ear bud 270 and/or ear bud 280. In various embodiments of the present invention, restraint element 210 may be manufactured from a pliable substance such as rubber, silicone, wood, or the like. In other embodiments, restraint element 210 may be manufactured from a metal (e.g. wire) that may be temporarily deformed from a first shape by the user into a second shape that attempts to return to the first shape.

Figure 2B:
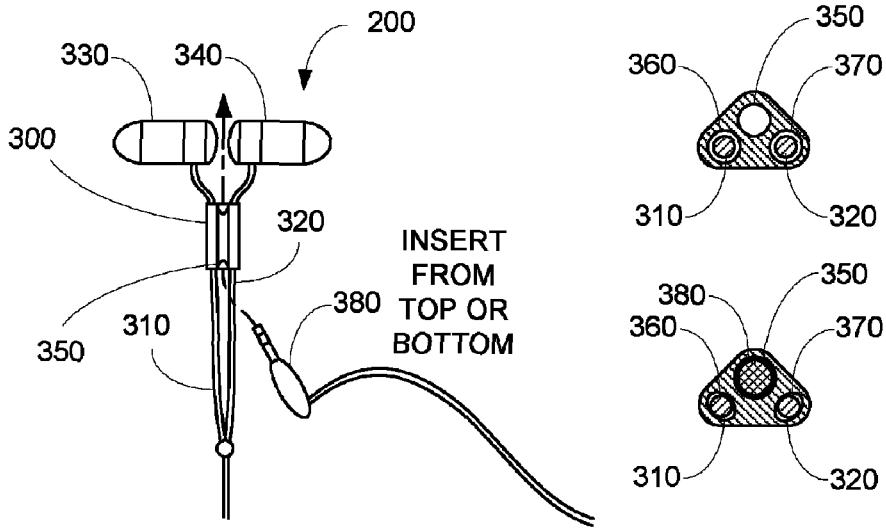

FIG. 2B illustrates additional embodiments of the present invention. As can be seen in this example, similar to the embodiments in FIG. 2A, a restraint element 300 is provided that may slide up and down first wire 310 and second wire 320 that lead to ear buds 330 and 340. As can be seen in FIG. 2B, in contrast to the embodiment in FIG. 2A, the pathway 350 is not perpendicular to wires 310 and 320, instead, pathway 350 is illustrated to be approximately parallel to pathway 360 and pathway 370. In operation, similar to FIG. 2A, to store the headphones, a user may slide restraint element 300 towards ear bud 330 and 340, and then insert the audio input portion 380 into pathway 350, to thereby form the temporary wire loop.

In various embodiments of the present invention, the sliding resistance between first wire 310 and pathway 310 and the sliding resistance between second wire 320 and pathway 370 may remain very low while pathway 350 is empty. However, as shown in cross-section, when audio input portion 380 becomes restrained by restraint element 300 (e.g. audio input portion 380 inserted into pathway 350 (e.g. hole), the sliding resistance between first wire 310 and pathway 310 and the sliding resistance between second wire 320 and pathway 370 increases.

Figure 2C:
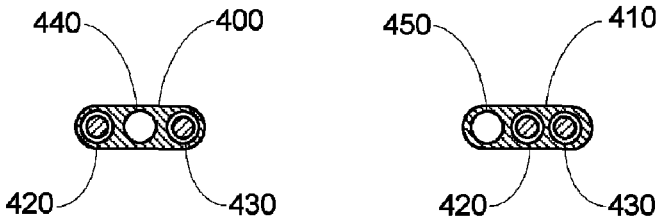

Additional related embodiments of the present invention are illustrated in FIG. 2C. In contrast to the embodiments in FIG. 2B, the pathway may be approximately in the same plane as the other pathway. As illustrated in FIG. 2C, wires leading to ear buds pass through paths 420 and 430 of restraint elements 400 and 410. In various embodiments, a pathway 440 is illustrated between paths 420 and 430 of restraint element 400; and in other embodiments path 430 is illustrated between paths 420 and a pathway 450 of restraint element 410. Accordingly, one of ordinary skill in the art would recognize many other possible configuration permutations, in view of the present invention disclosure.

Figure 2D:
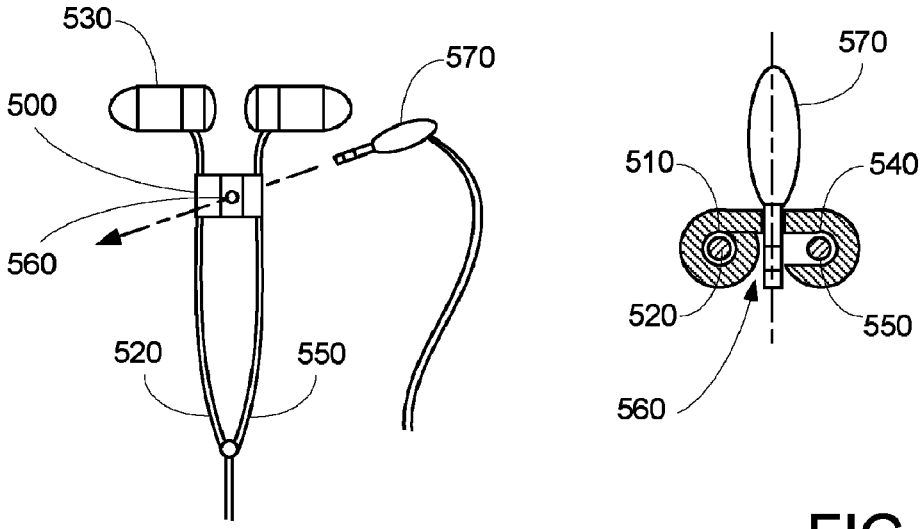

FIG. 2D illustrate additional embodiments of the present invention. As can be seen in this example, similar to the embodiments in FIG. 2A, a restraint element 500 is provided with a pathway 510 that may slide up and down a first wire 520 that leads to ear bud 530. However, in contrast, as can be seen in FIG. 2D, a pathway 540 is not a hole, but is merely "J" shaped. Accordingly, it is contemplated that if second wire 550 is placed within pathway 540, wire 550 will not be appreciably restrained by restraint element 500 alone.

In various embodiments, similar to the embodiments in FIG. 2A, a pathway 560 is provided to restrain audio input portion 570 in a somewhat transverse direction relative to pathway 510 and pathway 540. As can be seen in FIG. 2D, when audio input portion 570 is restrained within restraint element 500 by pathway 560 while second wire 550 is placed within pathway 540, then audio input portion 570 helps physically restrain second wire 550 within pathway 540. In various embodiments, the metal plug portion of audio input portion 570 may tightly restrain second wire 550 within pathway 540 such that the sliding friction between second wire 550 and pathway 540 is high, however in other embodiments, the sliding friction between second wire 550 and pathway 540 may remain low.

Figure 2E:
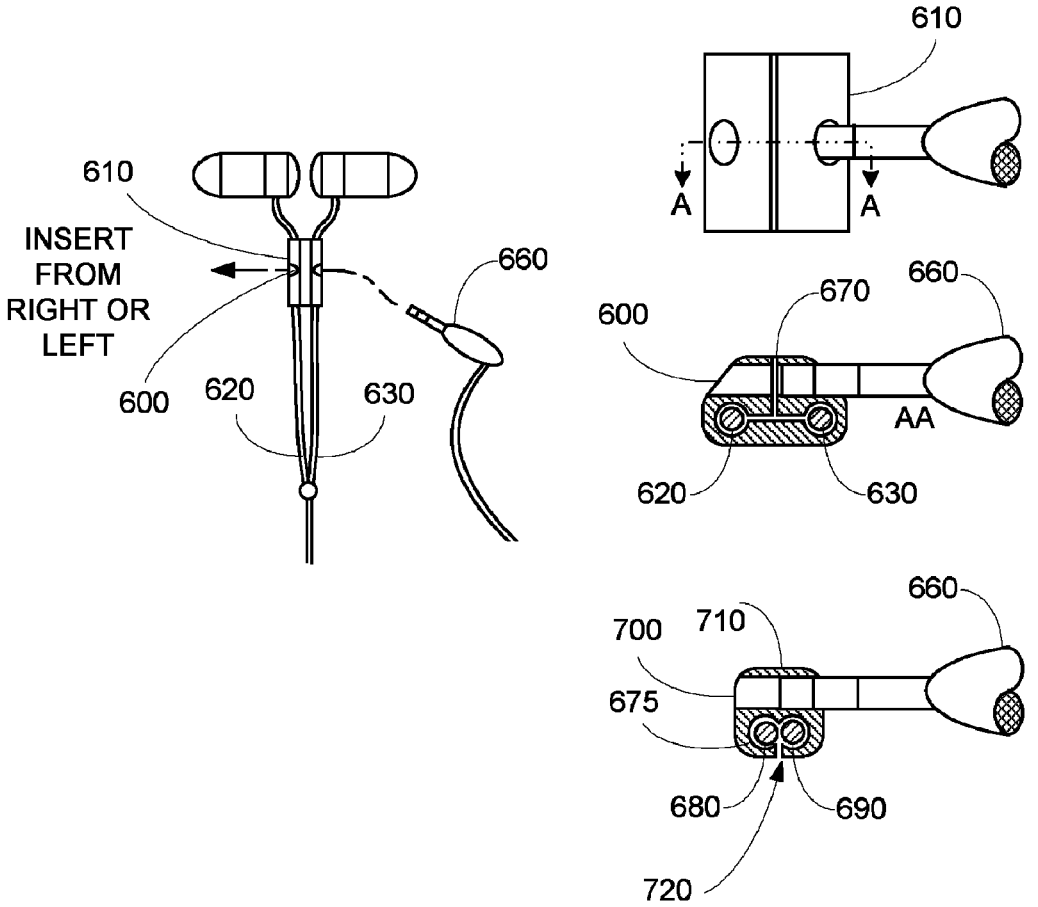

FIG. 2E illustrates additional embodiments of the present invention. Similar to the embodiments illustrated in FIG. 2B, a pathway 600 of a restraint element 610 need not be between a first wire 620 and a second wire 630. In these embodiments, pathway 600 is configured in a transverse direction relative to first wire 620 and 630. In the example in FIG. 2E, pathway 600 is illustrated as a hole within restraint element 610. Similar to the embodiments in FIG. 2B, the sliding resistance between restraint element 610 and wires 620 and 630 may be relatively low when audio input portion 660 is not inserted into pathway 600, but the sliding resistance increases when audio input portion 660 is restrained by pathway 600.

In some embodiments, restraint element 610 may be removable from the headphones. It is contemplated that restraint element 610 may be formed from a relatively flexible material, such as silicone, rubber, or the like. As can be seen, restraint element 610 may include one or more slits 670, such that wires 620 and 630 may be removed from restraint element 610 via slits 670. Conversely slits 670 may allow the user to "upgrade" their headphones by placing wires 620 and 630 within restraint element 610. In various embodiments, when audio input portion 660 is restrained by pathway 600, slit 670 may be physically held closed by audio input portion 660. Accordingly, wires 620 and 630 would remain restrained by restraint element 610.

In additional embodiments of the present invention, instead of two paths for the two wires, a single path 675 is used to restrain both wires 680 and 690. In various embodiments, a slit or opening 720 is illustrated in the opposite direction as slit 670. It should be understood the direction of the slits may vary according to engineering preference, further, slits or openings are shown as being spaced apart, merely for sake of understanding. It is contemplated that in various embodiments, the portions that are split apart by such slits may normally be physically adjacent. In various embodiments, a path 700 of a restraint element 710 can be oriented in a transverse direction relative to single path 675, or in an approximately parallel direction relative to path 350 similar to that of FIG. 2B.

Figure 2F:
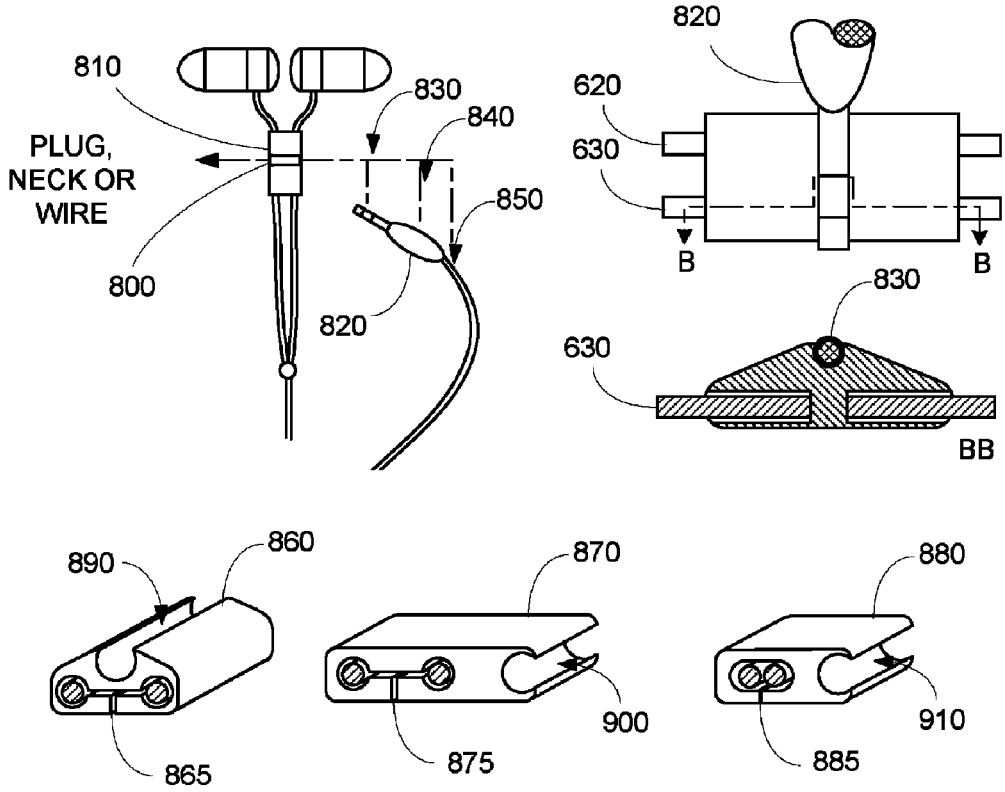

In the embodiments illustrated in FIG. 2F, a path 800 is illustrated as a semicircular groove within restraint element 810. As can be seen in this example, path 800 may be adapted to restrain different elements of audio input portion 820. For example, path 800 may be physically adapted to restrain the metal-plug element 830, the housing element 840, the strain-relief/wire 850, or the like.

In additional embodiments, the semicircular groove is adapted to restrain audio input portion 820 may be approximately parallel to the wire paths, as illustrated by devices 860-880. Additionally, as illustrated in devices 860-880 may also include slits 865-885, respectively in the material. It is contemplated that the material be made of material sufficiently pliable such as plastic, silicone, rubber, or the like. As described above, these slits and the pliable material allow the user to place the wires within or remove wires from restraint devices 860-880. Further, as illustrated in various embodiments described, pathways 890-910 may be approximately parallel to the wire paths, and may be positioned in a variety of locations upon restraint devices 860-880. Additionally, as shown in restraint device 880, one wire path is provided for both headphone wires, and one path is provided to restrain the audio input portion.

Figure 2G:
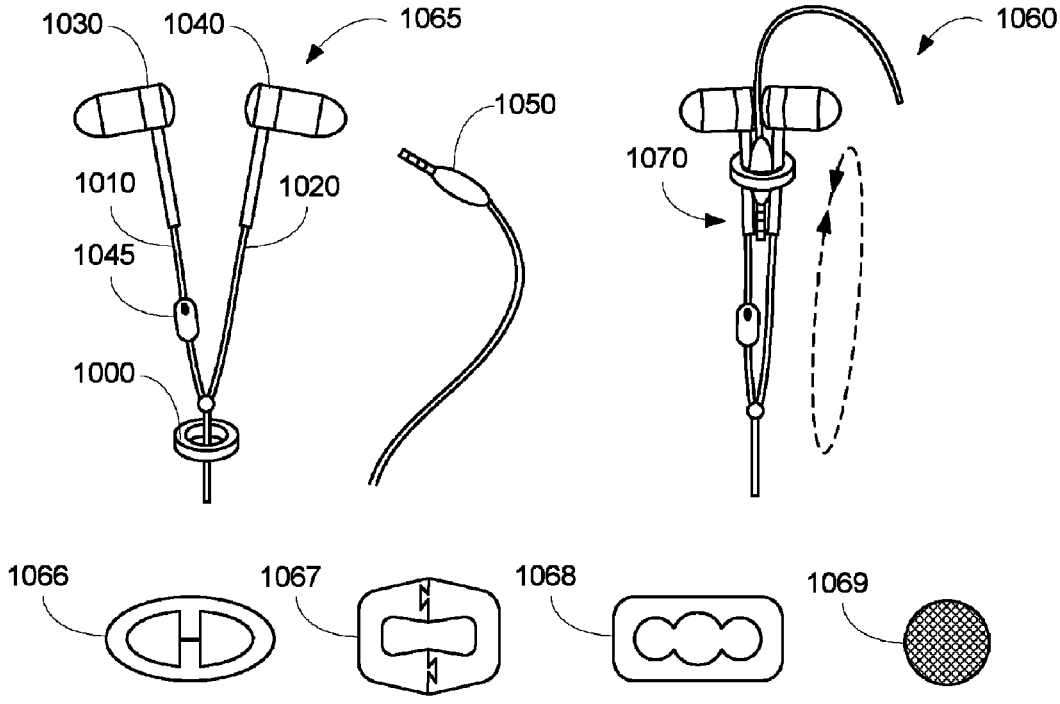

In still other embodiments of the present invention, a single path may be used, such as a small ring-type structure (open or closed circle) 1000, as illustrated in FIG. 2G. In such embodiments, similar to the embodiments described above, a user would be able to reposition the small ring 1000 up and down wires 1010 and 1020 coupled to ear buds 1030 and 1040 including microphone 1045. In such embodiments, the user would then position ring 1000 near ear buds 1030 and 1040, and then insert the audio input portion 1050 into the opening of small ring 1000, as illustrated in configuration 1060.

In various embodiments, it is contemplated that because the opening of ring 1000 would be small in its internal diameter, when headphone wires 1010 and 1020 and audio input portion 1050 are inserted therein, the sliding resistance between wires 1010 and 1020 and ring 1000, as well as the sliding resistance between audio input portion 1050 and ring 1000 are increased. As can be seen, a temporary and removable loop in headphone wires 1010 and 1020 are formed. When audio input portion 1050 is removed from ring 1000, the sliding resistance between wires 1010 and 1020 and ring 1000 should greatly decrease, thus the user would be able to freely separate and use ear buds 1030 and 1040. In various embodiments, it may be desirable for ear buds 1030 and 1040 to have an increase in size or flare around regions 1070 to further facilitate the restraint of ring 1000 when in configuration 1060.

In various embodiments, ring 1000 may be made of a rigid material such as metal, hard plastic, wood, or the like, a soft material such as silicone, soft plastic, rubber, bent wire (e.g. spiral), or the like. In embodiments where more pliable materials are used, there may be less stress on the wires and wire casings against ring 1000, and more deformation of ring 1000, when audio input portion 1050 is inserted. In one embodiment, a pair of headphones included a ⅝" OD and a ⅜" ID rubber grommet ¼" thick for small ring 1000 and was able to restrain the housing portion of the audio input portion 1030. In another embodiment, a pair of headphones included a 9/16" OD and a ¼" ID rubber grommet ¼" thick for small ring 1000 and was able to restrain the metal plug portion of the audio input portion 1050.

In various embodiments of the present invention, small ring need not be circular in the interior shape. For example, small ring may have an exterior or interior oval shape, star shape, egg shaped, foot-ball shaped, or any other shape. Additionally, the interior shape may have any number of flexible protrusions. These types of embodiments may be useful to reduce the occurrence of small ring accidentally falling off the headphones. As an example, small ring 1066 may be round or oval with two interior protrusions projecting from opposite walls and meeting in the center, or the like. In a unperturbed state, small ring 1066 would look similar to a lower case Greek theta letter, "θ." In operation, as audio input portion 1069 is forced through small ring 1066, the interior protrusions will bend out of the way and the interior shape may also change. Afterwards, the interior protrusions and the interior shape would flex back to their original positions. The interior protrusions would then prevent small ring 1066 slipping off of audio input portion 1069 or from the wire divider without deliberate force.

As another example, small ring 1068 may appear similar to two or three partially overlapping circles in a row round with four interior protrusions projecting from opposite walls. Similar to the embodiment above, as audio input portion 1069 is forced through small ring 1068, the interior protrusions will bend out of the way. Additionally, the overall shape of small ring 1068 may flex into a shape similar to the cross-section of audio input portion 1069. Afterwards, the interior protrusions and the overall shape of small ring 1068 will return to the unperturbed shape. In such an example, both the interior protrusions and the overall interior shape of small ring 1068 would then prevent small ring 1068 slipping off of audio input portion 1069 without deliberate force. As can be seen in various embodiments, the external shape and the internal shapes of the small ring need not be the same.

In another embodiment, small ring 1067 may be made of two or more pieces that have an interior perimeter smaller than audio input portion 1069 yet larger than an in-line microphone (e.g. 1045). In operation, the user would assemble small ring 1067 along the headphone wires, but above audio input portion 1069. Accordingly, small ring 1067 is physically restrained from slipping from the headphones past the ear buds and audio input portion 1069. In light of the present disclosure, one of ordinary skill in the art will be able to imagine many other shapes and configurations that will be within the scope of embodiments of the present invention.

In various embodiments, one or more microphones 1045 are located alone wires leading to the ear buds of some headphones. Accordingly, the inner perimeter of the small rings may be greater than or approximately equal to the perimeter of the microphone in some embodiments. This is so that the small ring may be positioned below the microphone, i.e. out of the way, when the user is using their headphone as shown in configuration 1065, but can be repositioned above the microphone and adjacent to the ear buds when the user wants to store the headphones, as shown in configuration 1060. In such embodiments, it may be desirable to have the small ring to have a inner perimeter less than the perimeter of the housing of the audio input portion, so that the small ring does not inadvertently fall off when the user is using the headphone. In various embodiments, if the small ring is made of pliable and stretchable materials, the inner perimeter of the small ring may be further adjusted in the spirit of the discussion above.

In some embodiments, the inner diameter of ring 1000 may be slightly smaller than the plastic/metal housing portion of the audio input device. To assemble such a headphone, after assembling the headphone, ring 1000 can be forced over the plastic/metal portion of the audio input device and forced over the wire divider, if any. In such a configuration, the tendency for ring 1000 to fall off the headphone wires is greatly reduced. In other embodiments, headphone wires 1010 and 1020 can be threaded through ring 1000 before ear buds 1030 and 1040 are attached.

Figure 2H:
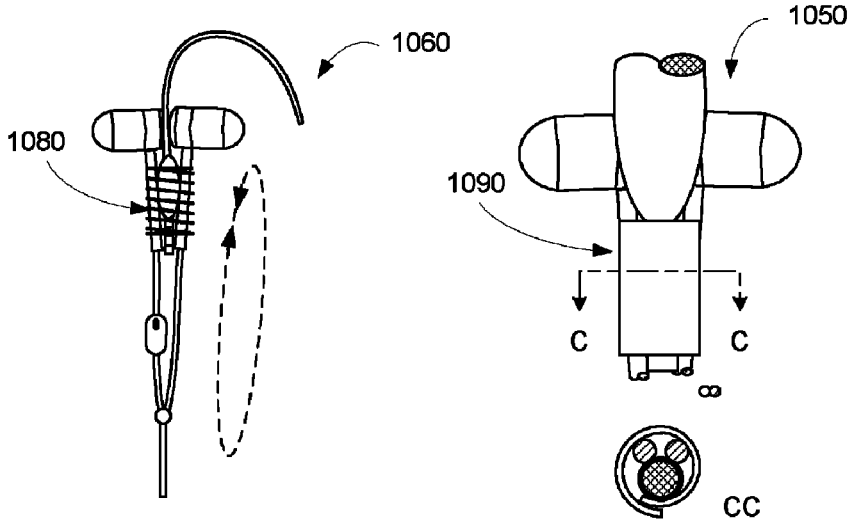
Figure 2I:
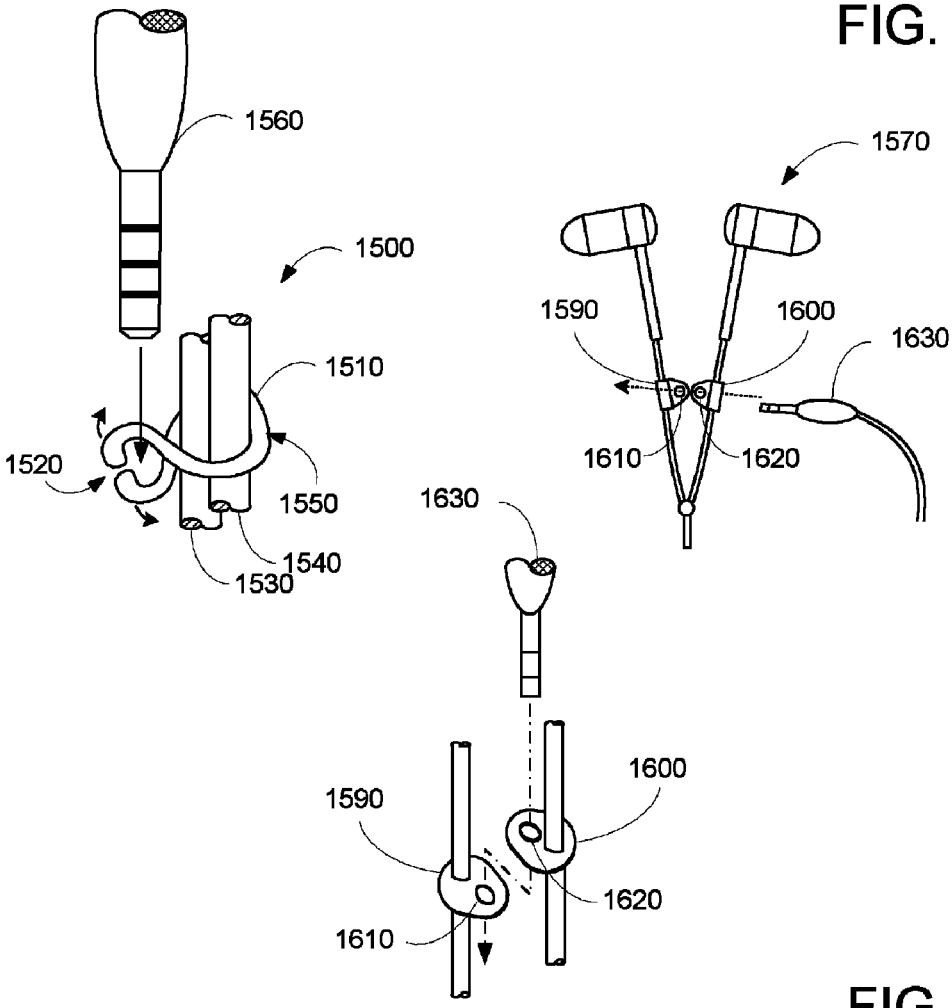

FIG. 2H illustrates additional embodiments of the present invention. More specifically, FIG. 2I illustrates a small ring embodied as a coil of wire 1080, e.g. spring. In various embodiments, the inner diameter of the coil of wire may be smaller than the diameter of a wire divider. In some embodiments, only the metal portion of the audio input device may be restrained by wire 1080. In such embodiments, the coil of wire may have an inner diameter smaller than the plastic/metal housing of the audio input device. In such an example, to assemble the headphones, because the inner diameter is smaller, to attach coil of wire 1080 to the headphones, the headphone wires may be wound or pulled between the coils of wire 1080 until the wires are completely within wire 1080. Alternatively, similar to the above, the headphone wires may be inserted through wire 1080 before the ear buds are attached.

In other embodiments, a cylinder 1090 of pliable material is used as a restraint device. Similar to the above, in various embodiments, the inner diameter of cylinder 1090 may be large enough to restrain movement of the metal plug portion of the audio input device and/or the housing portion. As the audio input device is inserted inside cylinder 1090, cylinder 1090 may expand in size and restrain the movement of ear buds and the audio input device. In some embodiments, as illustrated in FIG. 2H, cylinder 1090 may be made of plastic, silicone, metal, for example, and have an opening into which the headphone wires are inserted. Accordingly, cylinder 1090 may be included on the headphones after the ear buds are coupled to the headphone wires. In other embodiments, cylinder 1090 may be made of a short length of rubber tubing, silicone tubing, spring metal, or the like. In such embodiments, to assemble the headphones, cylinder 1090 may be pulled over the housing of audio input portion and the wire divider, or cylinder 1090 may be placed around headphone wires before ear buds are connected to the headphone wires.

In various embodiments of the present invention, the restraint device, e.g. cylinder 1090, restraint devices 860-880 may have different external shapes and/or different interior shapes. For example, the external shape may be any desired shape, such as a sphere, a company logo, a cube, a cone, a prism, a star, or the like. Additionally, the internal shape where the headphone wires/ear buds are restrained may be approximately circular shaped, triangular shaped, square shaped, or the like. In light of the above disclosure, one of ordinary skill in the art will be able to imagine any number of additional shapes that are within the scope of the present patent application disclosure.

In light of the above detailed patent disclosure, other embodiments of the present invention will be easily imagined to one of ordinary skill in the art. For example, other embodiments are illustrated in FIG. 2I. In configuration 1500, for example, a restraint mechanism 1510 may be formed from a single piece of wire and may be shaped in a figure "8" type pattern, with the top of the loop 1520 open. In such an example, the headphone wires 1530 and 1540 (or portions of the respective ear buds, e.g. neck) are placed within the bottom loop of wire 1550, and top open loop 1520 is adapted to restrain the metal input portion of the audio input device 1560. In operation, when top of the loop 1520 is spread apart to restrain the metal jack portion of audio input device 1560, bottom loop of wire 1550 is somewhat squeezed, thus restraining mechanism 1500 restrains the movement of the audio input device 1560 and headphone wires 1530 and 1540.

Additional embodiments are illustrated as configurations 1570 and 1580. As can be seen, restraint mechanisms include portions 1590 and 1600, including holes 1610 and 1620. In various embodiments, holes 1610 and 1620 may have an inner diameter slightly smaller than the diameter of the metal jack portion of audio input device 1630. In operation, when the user inserts the metal jack into slightly smaller holes 1610 and 1620, portions 1590 and 1600 somewhat restrain the metal jacket from being removed from holes 1610 and 1620. Further, in some respect, the metal jack portion of audio input device 1630 also is part of the restraint mechanism, as it serves, in various embodiments to restrain the movement of the ear buds away from each other.

Figure 3A:
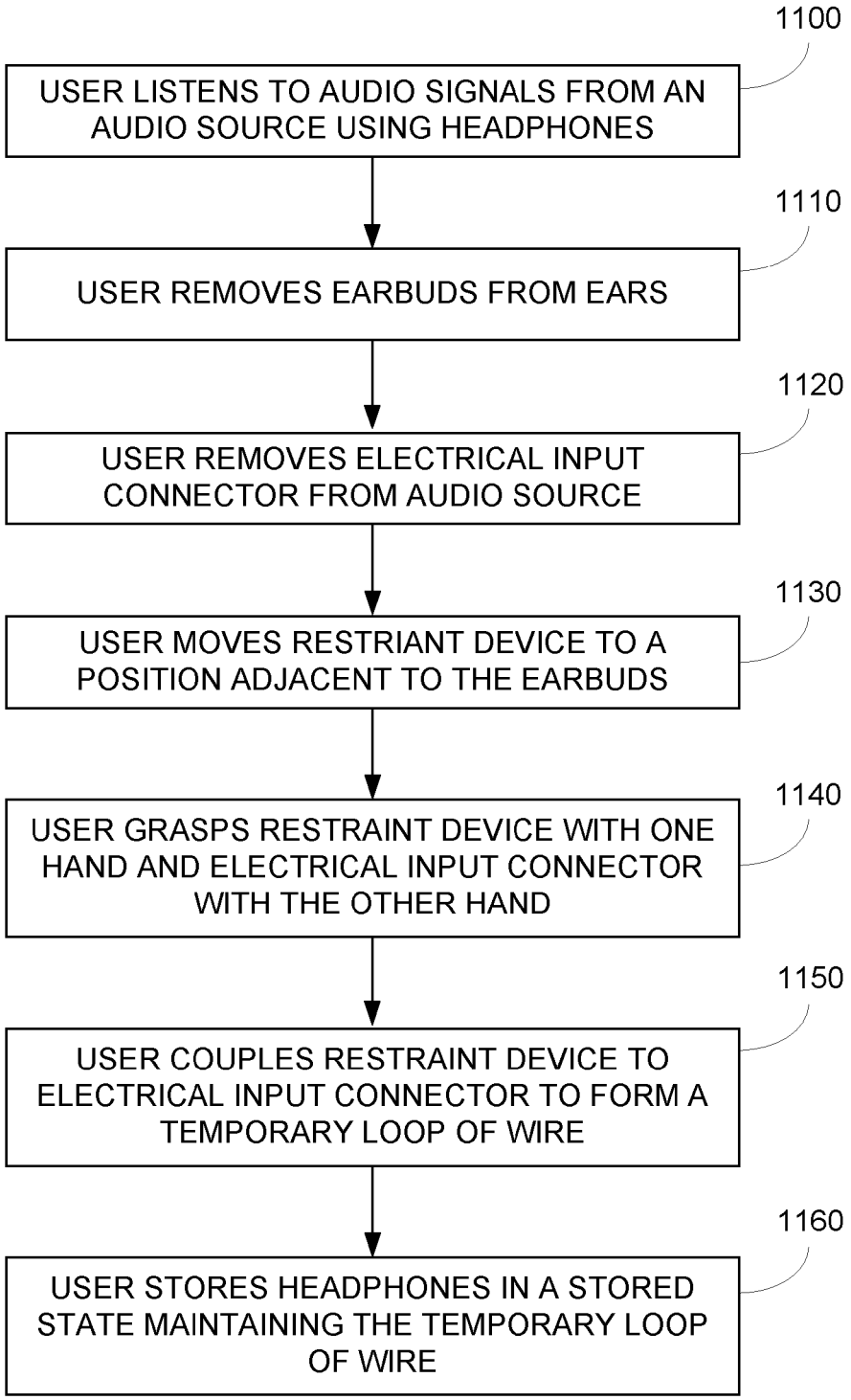
FIGS. 3A-B illustrate block diagrams of a process for operating embodiments of the present invention.
Figure 3B:
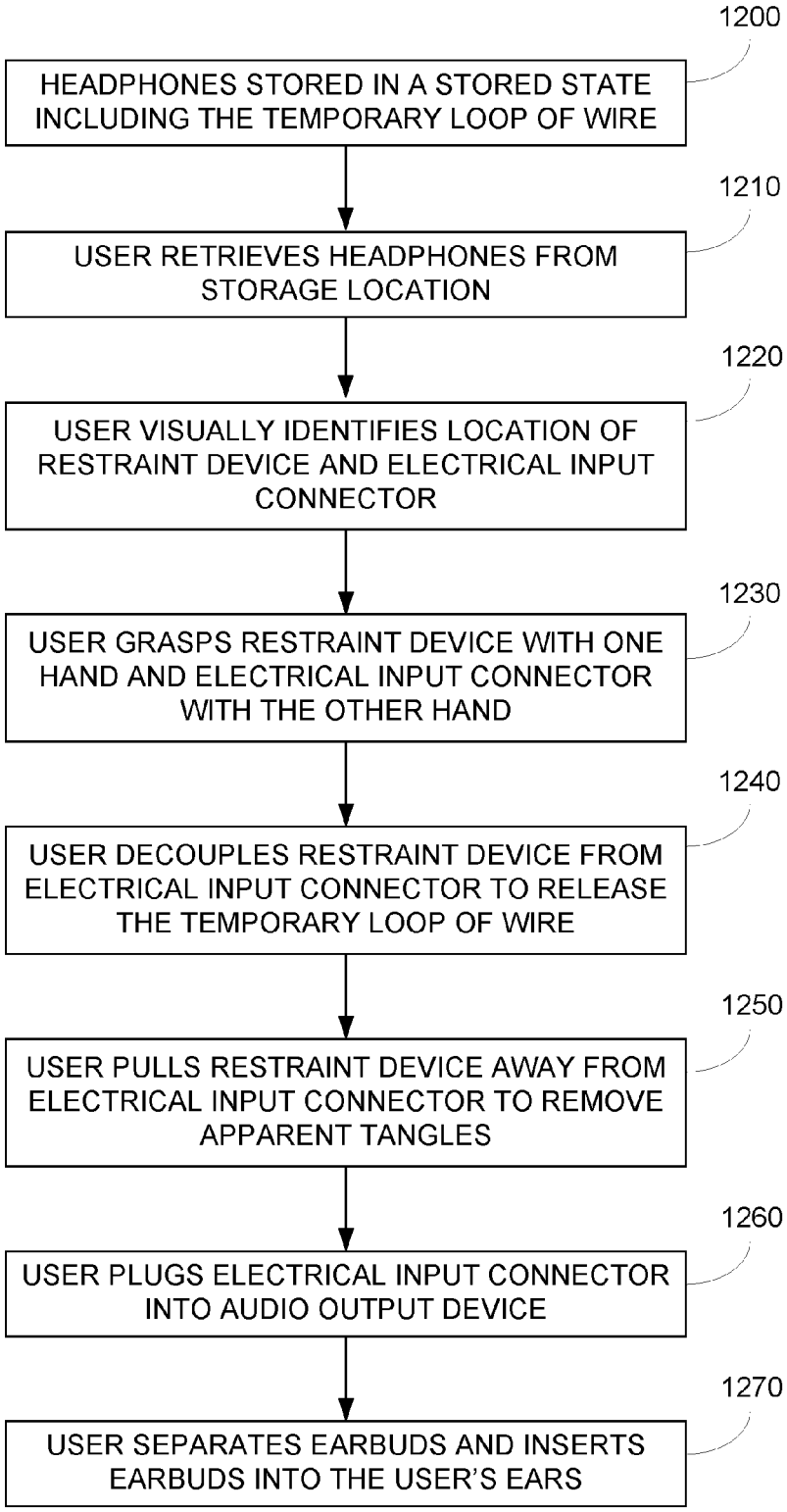

FIGS. 3A-B illustrate a block diagrams of a flow chart according to various embodiments of the present invention. More particularly, FIG. 3A illustrates a user performed process for storing embodiments of headphones described herein in a configuration having a reduced tendency to tangle.

Initially, a user listens to audio signals from an audio source using headphones, step 1100. In various embodiments, audio source may be any conventional electrical audio output device, such as a computer, a portable media device (e.g. Apple iPad, Amazon Kindle), a mobile telephone (e.g. Google NexusOne, Palm Plus), or the like. In various embodiments, headphones may be embodied as in-ear ear buds, over the ear phones, or the like.

Next, when the user is interested in storing their headphones, the user removes the ear buds (e.g. 110 and 120) from their ears, step 1110. This may be performed in a number of ways, such as the user grasping and directly pulling one or both of the ear buds from their ears; the user pulling on wires connected to the ear buds; the user pulling upon the electrical input connector; the user pulling upon the restraint device or wire divider; or the like.

In some embodiments of the present invention the user removes the electrical input portion or connector (e.g. 130) of the earphones from the audio output device, step 1120. This may be performed in a number of ways, such as the user grasping and directly pulling upon a housing or strain relief of the electrical input connector; the user pulling upon a wire coupled to the electrical input connector; and the like.

In some embodiments, the restraint element (e.g. 170) is slidable along one or both of the ear bud wires (e.g. 140 and/or 150) and is either already positioned approximately adjacent to or over portions of one or both ear buds, or the user positions the restraint element approximately adjacent to or over portions of one or both ear buds, step 1130. As an example, during normal usage, the restraint element is positioned adjacent to or near a divider (e.g. 165), as illustrated in FIG. 1A. Thus, in this step, the user moves the restraint element upwards along the headphone wires towards the region of the ear buds, as illustrated in FIG. 1B. In some of the embodiments described above, portions of the ear buds may be positioned inside the restraint element in this step.

Next, in various embodiments, the user holds the restraint device with one hand and the electrical input portion with the other hand, step 1140. The user then physically couples the restraint device to the input portion, step 1150. As described above, the metal plug portion of the input portion may be restrained by the restraint device; the metal/plastic housing of the input portion may be restrained by the restraint device; the wire adjacent to the housing may be restrained by the restraint device; or the like. Depending upon specific configuration of the restraint device, the movement of the input portion is thereby somewhat restrained relative to the ear buds, and/or the ear buds are restrained with respect to each other. In this configuration, the discussed temporary loop of wire is formed.

In various embodiments, the user may then store the earphones in any desired manner, step 1160. In some embodiments, the user may wind the earphones (having the temporary loop) around the audio output device; the user may wind the earphones (with temporary loop) around their hand and then place the earphones in a pouch, pocket, or the like; the user may place the temporary loop (carefully) over their head; or the like. In various embodiments, the earphones are then said to be in a stored state.

In other embodiments of the present invention, the restraint mechanism may be affixed to or integral to the ear buds or the electronic input connector. In such cases, step 1130 may not be needed. For example, as can be seen in some of the embodiments below, if the restraint mechanism is integral to the input electrical connector, in step 1140, the user would grasp the restraint device/input connector with one hand and the ear buds with the other hand. Then, in such an example, in step 1150, the user would couple (e.g. "snap in") the ear buds to the restraint device/input connector. As another example, as can be seen in some of the embodiments below, if the restraint mechanism is integral to the ear buds, in step 1140, the user would grasp the restraint device/ear buds together with one hand and the electrical input connector with the other hand. Then, in such an example, in step 1150, the user would couple (e.g. "plug-in," "snap in," "insert") the electrical input connector into the restraint device/ear buds.

FIG. 3B illustrates a block diagram of a flow chart of various embodiments of the present invention. In particular, FIG. 3B illustrates a user performed process for removing the earphones from a storage configuration.

Initially, the earphones are stored in the stored state (e.g. including the temporary loop of wire), step 1200. Then user removes the earphones from the storage container, pouch, pocket or the like, step 1240. It has been observed by the inventor, that earphones typically stored in such a manner include a large mass of tangled wire.

Next, in various embodiments, the user visually identifies the location of the electrical input connector or portion, the restraint device, and/or the ear buds, step 1220. Because restraint device restrains the input portion relative to the ear buds, it is expected that the user may easily identify one or more of these elements from the mass of wires.

In various embodiments, the user grasps the input portion with one hand and the ear buds with their other hand, step 1230. In other embodiments, the user may grasp the restraint device with their other hand. Next, the user begins pulling her hands apart, step 1240. In various embodiments, the input portion is thereby removed from the restraint device by this action.

In various embodiments, many if not most of the apparent tangles in the mass of tangled wires surprisingly disappear while separating the input portion from the ear buds, step 1250. As can be seen in the experimental data provided within the present disclosure, the amount of time it takes to detangle earphones stored as described herein with a temporary loop of wire is substantially shorter than without the temporary loop of wire.

Next, the user may plug the input portion of the earphones into the audio output device step 1260. Subsequently, the user may separate the ear buds and then insert them into her ears, step 1270. In various embodiments, as the user separates the ear buds, the restraint device may slide towards divider 165. In other embodiments, the user may deliberately slide the restraint device towards divider 165 before separating the ear buds. The user may then begin listening to audio data from the audio output device in a conventional manner.

In various embodiments of the present invention that will be described below, the restraint mechanism may be affixed to or integral to the ear buds or the electronic input connector.

FIGS. 4A-G illustrate various embodiments of the present invention. Generally, FIGS. 4A-G illustrate "plug-in" or "snap in" embodiments of the present invention, where restraint mechanisms are incorporated into the ear buds, and the audio input portion (e.g. jack) is plugged into the restraint mechanism to form the temporary loop of wire.

FIG. 4A illustrates various embodiments of the present invention. More specifically, in the example in FIG. 4A, ear buds 1300 and 1310 are illustrated including restraint mechanisms: eyelets 1320 and 1330, respectively. In various embodiments, eyelets 1320 and 1330 may be manufactured integrally into ear buds 1300 and 1310. For example eyelets 1320 and 1330 may be made of the same material as the casing of ear buds 1300 and 1310, or the like. In other embodiments, eyelets 1320 and 1330 may be welded or glued onto ear buds 1300 and 1310, after ear buds 1300 and 1310 have been attached.

In operation, to store headphones 1340, a user grasps audio input portion 1350 and inserts it into eyelets 1320 and 1330. As described above, eyelets 1320 and 1330 may have an inner diameter slightly smaller than the metal portion of audio input portion 1350 or the casing portion of audio input portion 1350. Because the inner diameters are slightly small, they somewhat restrain the movement of audio input portion 1350 with respect to ear buds 1300 and 1310.

In various embodiments, the restraint mechanism may refer to eyelets 1320 and 1330, as well as the restrained portion of the audio input portion. This is because the restrained portion, e.g. metal plug also serves to restrain movement of ear bud 1330 away from ear bud 1320. This also applies to many of the embodiments described herein.

FIG. 4B illustrates various embodiments of the present invention. More specifically, FIG. 4B illustrates different configurations for restraining mechanisms similar to that illustrated in FIG. 4A. For example, in configuration 1400, eyelets 1410 and 1420 are oriented approximately 90 degrees from eyelets 1320 and 1330. As another example, in configuration 1430, eyelets 1440-1460 are oriented at approximately another 90 degrees different from eyelets 1320 and 1330. Additionally, configuration 1430 illustrates eyelets 1440-1460 being configured in an interleaved pattern for restraint stability. Yet another configuration 1470 is illustrated in FIG. 4B. In configuration 1470 it is noted that the ear buds may be "back to back" as shown, or the ear buds may face the same direction, as eyelets 1480 and 1490 protrude from the rear of the ear buds. In an alternative configuration 1360, one or both ear buds may have more than one eyelets. In such embodiments, before inserting the audio input portion into the eyelets, the eyelets of the different ear buds are first placed into an interleaved configuration, as shown, for sake of restraint stability, before audio input portion 1350 is inserted into the eyelets (loops).

In other embodiments of the present invention, as illustrated in configuration 1495, the restraint mechanism need not include eyelets or holes. Instead, as shown, grooves, semicircular channels, or the like, may be used to restrain the movement of the audio input device away from the ear buds.

Figure 4C:
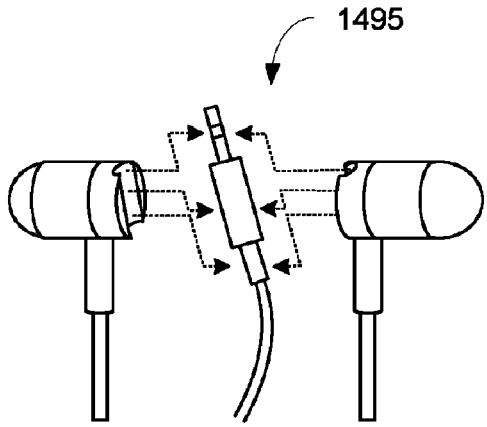
Figure 4C:
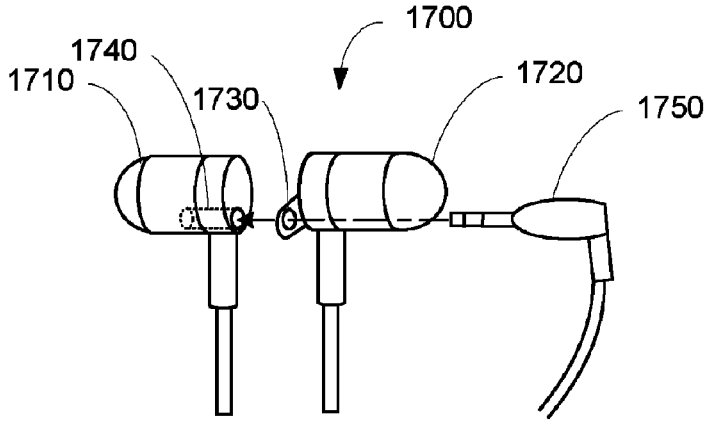

FIG. 4C illustrates various embodiments of the present invention. More specifically, FIG. 4C illustrates embodiments where the audio input portion is inserted into one of the audio output portions (e.g. ear buds).

In the example in FIG. 4C, headphone 1700 is illustrated with ear buds 1710 and 1720. Similar to the embodiments illustrated in FIGS. 4A and 4B, ear bud 1720 may have an eyelet 1730 integrally formed, or affixed there on. In contrast to FIGS. 4A and B, however, an internal sleeve (cavity) 1740 is formed within ear bud 1710. In various embodiments, internal sleeve 1740 is configured to tightly hold the metal plug portion of audio input portion 1750. To provide such functionality, internal sleeve 1740 may have a diameter that is slightly smaller than the metal plug of audio input portion 1750; one or more protrusions in internal sleeve 1740 reduce the size of internal sleeve 1740; or the like. In various embodiments, eyelet 1730 may have a diameter greater than the diameter of the metal plug.

In operation, to store headphones 1700, a user would grasp audio input portion 1750, thread eyelet 1730 over the metal plug, and then insert the metal plug into internal sleeve 1740. As internal sleeve 1740 restrains the movement of the metal plug away from ear bud 1710, the metal plug restrains the movement of ear bud 1720 away from ear bud 1710. Accordingly, the temporary loop of wire is formed.

Figure 4D:
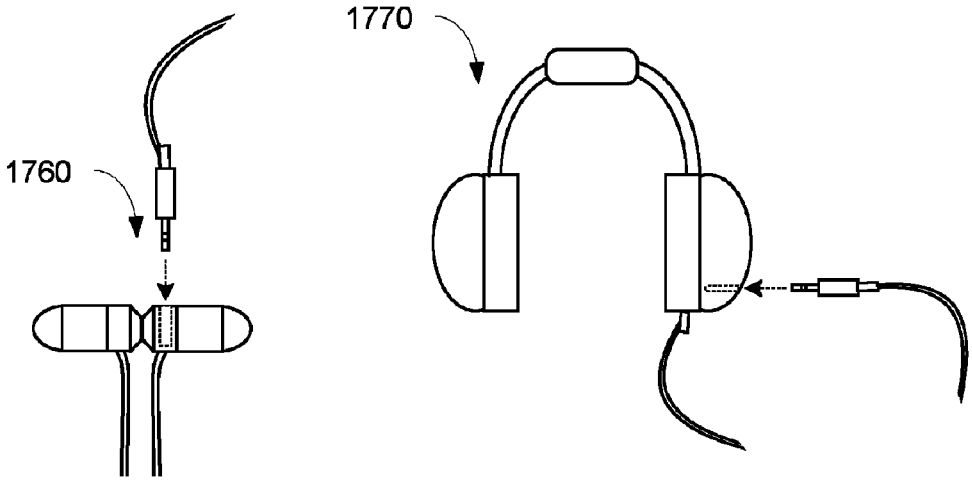

FIG. 4D illustrates various embodiments of the present invention. More specifically, FIG. 4D illustrate different configurations for restraining mechanisms similar to that illustrated in FIG. 4C. In various embodiments, the internal sleeve may be positioned virtually anywhere on ear bud. For example, internal sleeve may be on the top or side of ear bud 1710 having an axis in the same direction as the ear bud magnet as shown in configuration 1700; and internal sleeve may be on the top of the ear bud having an axis pointing down towards the wire as shown in configuration 1760. In the latter example, an external magnet, or the like may be used to secure the two ear buds. Additionally, embodiments may be applied to traditional over the ear headphone, or applied to microphone/earphone headsets. Additionally, in various embodiments, the eyelet may be positioned in any number of locations upon the other ear bud.

Figure 4E:
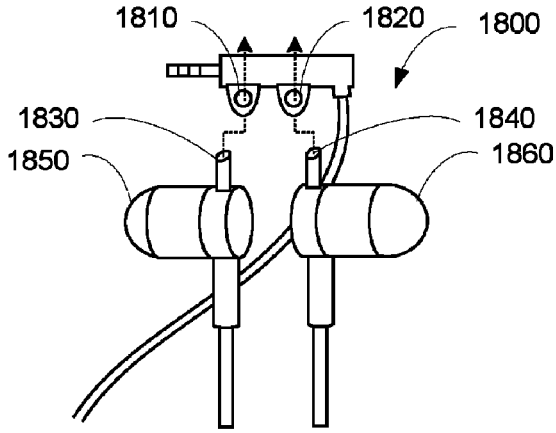

FIG. 4E illustrates various embodiments of the present invention. More specifically, FIG. 4E illustrates embodiments where restraint mechanisms are included on the audio input device.

In FIG. 4E, headphone 1800 includes eyelets 1810 and 1820, and ear buds 1850 and 1860 include protrusions 1830 and 1840, respectively. In various embodiments eyelets 1810 and 1820 may be formed integrally to audio input portion 1850 (i.e. same material); may be affixed via epoxy or the like to audio input portion 1850; may be part of a sleeve (e.g. silicone sleeve) surrounding audio input portion 1850; or the like. Additionally, protrusions 1830 and 1840 may be similarly formed in or upon ear buds 1850 or 1860. In various embodiments, eyelets 1810 and 1820 may have inner diameters that are slightly smaller than protrusions 1830 and 1840.

In operation, after the user removes ear buds 1850 and 1860 from her ears, she inserts protrusions 1830 and 1840 within eyelets 1810 and 1820. By doing so, audio input portion 1850 and ear buds 1850 and 1860 are somewhat restrained with respect to each other.

Figure 4F:
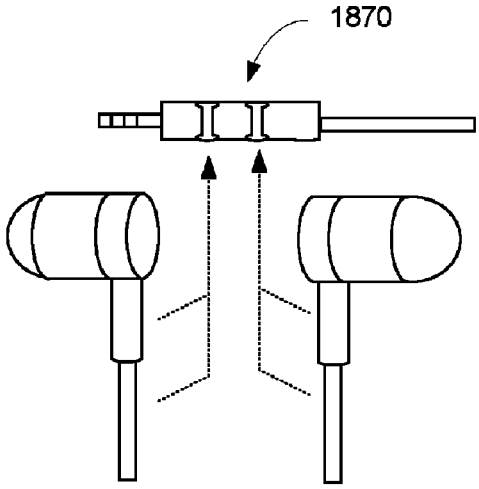
Figure 4F:
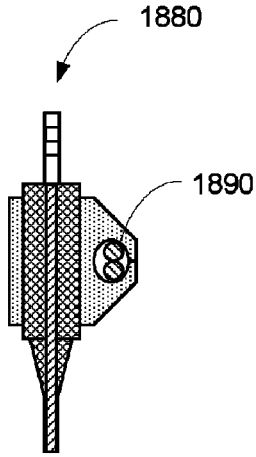

FIG. 4F illustrates various embodiments of the present invention. More specifically, FIG. 4F illustrates different configurations for restraining mechanisms similar to that illustrated in FIG. 4E. In various embodiments, semicircular grooves or slots are used instead of eyelets to restrain the ear buds (e.g. neck, wire), as illustrated in configuration 1870. As another example, a single wire restraint 1890 may be used to restrain headphone wires or ear buds, as illustrated in cross-section configuration 1880. In various embodiments, the slots or grooves are part of the housing for the audio input portion, whereas in other embodiments, the slots or grooves are in a material that is wrapped around the audio input portion. Such configurations would be useful for upgrading a user's existing headphones to become embodiments of the present invention. In various embodiments, the restraint mechanism may be made of a pliable material such that the headphone wires can be inserted or removed without undue force, e.g. less than five pounds, less than two pounds, or the like.

Figure 4G:
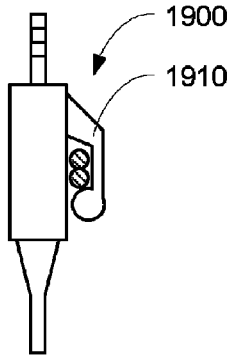

FIG. 4G illustrates additional embodiments of the present invention. More specifically, FIG. 4G illustrates embodiments where audio input portions includes a clip-type restraining mechanisms. As shown in configuration 1900, a clip-type structure 1910 may be used to restrain wires adjacent to the ear buds, portions of the ear buds, or the like. In operation, after the user removes her headphones, she can slide the wires adjacent to the ear buds under clip type structure 1910.

The inventors have confirmed the effectiveness in reducing the tangling tendency of various embodiments of the present invention. More specifically, for "headphone A", a headphone configured similar to that illustrated in FIG. 2A was repeatedly tangled and the amount of time to untangle the headphones was recorded. For headphone A, the untangling time was recorded with audio input portion 290 restrained by restraint element 210 and not restrained. After 20 trials were run, for un-looped headphones, the average untangling time was 15.2 seconds, with a standard deviation of 7.5 seconds. For the embodiment illustrated in FIG. 2A, with a single loop, the average untangling time was 7.7 seconds with a standard deviation of 3.4 seconds. Thus on average, the amount of time to untangle headphone A was reduced by about 50% and the standard deviation was also reduced by about 50%.

In another trial, for "headphone B", a headphone configured similar to that illustrated in FIG. 2F was repeatedly tangled and the amount of time to untangle the headphones was recorded. For headphone B, the untangling time was recorded with audio input portion 1050 restrained by restraint element 1000 and not restrained. After 20 trials were run, for un-looped headphones, the average untangling time was 18.8 seconds, with a standard deviation of 7.5 seconds. For the embodiment illustrated in FIG. 2F, the average untangling time was 5.3 seconds with a standard deviation of 3.2 seconds. Thus on average, the amount of time to untangle headphone B was reduced by about 72% and the standard deviation was reduced by about 57%.

In light of the above data, and additional trials run by the inventors, it is believed that headphones configured according to embodiments of the present invention are effective in reducing the amount of tangling of the wires when the headphones are stored. As a result, users of such headphones will be able to untangle their headphones more quickly and efficiently.

In various embodiments of the present invention, the term "somewhat" is used to refer to the restraint of movement of input portion and the output portions once a temporary loop of wire is formed by the user. In some embodiments, the movement restraint may be high such that if a user pulled upon the input portion and the output portion, the restraint element does not appreciably move along the wires connected to the output portions, and/or the temporary loop of wire is maintained. In various embodiments, the amount of movement may be less than one-eighth and inch or less, three mm or less, or the like. In such embodiments, to release the temporary loop of wire, the user may pull upon the input portion with one hand, and the restraint element, itself, with the other hand; the user may pull on the input portion with one hand and the headphone wires coupled to the ear buds with the other hand, and the like.

In various embodiments, configurations may not be desired by some users if the restraint element is rigid and tends to highly deform or damage wires connected to the output portions when the separation force is high. In other embodiments of the present invention, the amount of restraint may be adjusted such that as a user pulls upon input portion with one hand and one or both output portions, the restraint element slides along wires connected to the output portions, and/or the temporary loop of wire is released. In light of the above, it should be understood that the amount of restraint of movement among the restraint element, the output portion and the input portion may be adjusted for various embodiments.

Other embodiments of the present invention may be applied to other situations where tangled wires are also a problem. For example, a computer peripheral, such as USB travel mouse may include a non-functional USB port. In operation, when the user wants to store the mouse for traveling, the user plugs the USB connector of the mouse into the non-functional USB-sized port, thereby forming a temporary loop in the wire. It is believed that as a result, after retrieving the travel mouse from storage, the wires can easily be untangled by pulling the USB connector from the non-functional USB-sized port of the mouse.

As another example, a charger for an electronic device, such as an iPad, iPhone, Blackberry, or the like, typically includes a transformer portion coupled to a wall outlet, a long power wire, and an output plug. In such embodiments, after charging the device, the user may unplug the output plug from the device, and plug the output plug into the transformer. In some embodiments, the transformer may include a dummy port into which the output plug is to be inserted. In other embodiments of the present invention, the physical insertion of the output plug may also physically or electronically cause the transformer to enter a lower power consumption state. For instance, physical insertion of the output plug may cause a open circuit between the inputs of the transformer and the power line. Of course, appropriate insulation and care is required when connecting and disconnecting from the power line. In other examples, physical insertion of the output plug may cause an open circuit in the output side of the transformer, or the like.

Further embodiments can be envisioned to one of ordinary skill in the art after reading this disclosure. In other embodiments, combinations or sub-combinations of the above disclosed invention can be advantageously made. The block diagrams of the architecture and flow charts are grouped for ease of understanding. However it should be understood that combinations of blocks, additions of new blocks, re-arrangement of blocks, and the like are contemplated in alternative embodiments of the present invention.

The specification and drawings are, accordingly, to be regarded in an illustrative rather than a restrictive sense. It will, however, be evident that various modifications and changes may be made thereunto without departing from the broader spirit and scope of the invention as set forth in the claims.

What is claimed is:

1. A method for storing headphones having a plurality of ear buds and an audio plug coupled via a pair of wires and a restraining mechanism comprising:

grasping the restraining mechanism with one hand of a user;

grasping the audio plug with the other hand of the user;

inducing the restraining mechanism to slide along the pair of wires from a position away from the plurality of ear buds along the pair of wires to a position proximate to the plurality of ear buds along the pair of wires;

physically coupling the audio plug with the restraining mechanism thereby positioning the audio plug adjacent to the plurality of ear buds and thereby forming a temporary and removable closed loop of wire from the pair of wires;

wherein the restraining mechanism restrains, until a sufficient separation force is applied, movement of the audio plug with respect to the plurality of ear buds.

2. The method of claim 1 wherein a physical movement distance of a first ear bud with respect to a second ear bud before physically coupling the audio plug with the restraining mechanism is larger than a physical movement distance of the first ear bud with respect to the second ear bud after physically coupling the audio plug with the restraining mechanism.

3. The method of claim 1 further comprising:

applying at least the sufficient separation force between the restraining mechanism and the audio plug thereby separating the audio plug from the restraining mechanism and thereby releasing the temporary and removable closed loop of wire.

4. The method of claim 3 wherein a maximum value of the sufficient separation force is selected from a group consisting of: one kilogram, four pounds.

5. The method of claim 4 wherein a minimum value of the sufficient separation force is selected from a group consisting of: 0.5 pounds, two pounds.

6. The method of claim 3 wherein when an applied separation force that is less than the sufficient separation force is applied, the restraining mechanism restrains movement of the audio plug with respect to the plurality of ear buds by a distance in all directions selected from a group consisting of: less than 0.25 inches, 5 mm.

7. The method of claim 1 wherein physically coupling the audio plug with the restraining mechanism further comprises inserting the audio plug into an opening of the restraining mechanism and having the audio plug physically touch both of the plurality of ear buds.

8. The method of claim 1 wherein the headphone includes an in-line microphone positioned on one wire of the pair of wires; and wherein inducing the restraining mechanism further comprises inducing the restraining mechanism to slide from a position on the one wire below the in-line microphone to a position on the wire above the in-line microphone.

9. The method of claim 1 wherein physically coupling the audio plug with the restraining mechanism causes an internal opening of the restraining mechanism to increase from a first perimeter.

10. The method of claim 1 wherein no other loop of wire is formed from the pair of wires before the temporary and removable closed loop of wire is formed.

11. A headphone having reduced tendency to tangle Comprises:

an audio input portion configured to receive a plurality of electrical audio signals from an audio output device;

an audio output portion configured to provide audible output audio signals to a user in response to the plurality of electrical audio signals;

a plurality of wires coupled to the audio input portion and the audio output portion, wherein the plurality of wires are configured to provide the electrical audio signals to the audio output portion;

a restraint mechanism coupled to the plurality of wires, wherein the restraint mechanism is configured to be positioned at a plurality of positions along the plurality of wires, wherein the restraint mechanism is configured to physically receive insertion of at least a portion of the audio input portion, wherein the restraint mechanism is configured to physically restrain movement of the portion of audio input portion with respect to the audio output portion when the portion of the audio input portion is physically inserted into the restraint mechanism, thereby forming a temporary and removable closed loop of wire from the plurality of wires, until a sufficient separation force is applied.

12. The headphone of claim 11 wherein the audio output portion comprises a first ear bud and a second ear bud;

wherein the restraint mechanism is configured to restrain movement of the first ear bud with respect to the second ear bud; and wherein an amount of restraint of physical movement of the first ear bud with respect to the second ear bud provided by the restraint mechanism before the portion of the audio input portion is inserted into the restraining mechanism is smaller than an amount of restraint of physical movement of the first ear bud with respect to the second ear bud provided by the restraining mechanism after the portion of the audio input portion is inserted into the restraining mechanism.

13. The headphone of claim 11 further wherein the restraint mechanism is configured to allow the portion of the audio input portion to be physically removed from the restraint mechanism thereby releasing the temporary and removable closed loop of wire from the plurality of wires when at least the sufficient separation force between the restraining mechanism and the audio plug is provided.

14. The headphone of claim 13 wherein a maximum value of the sufficient separation force is selected from a group consisting of: one kilogram, four pounds.

15. The headphone of claim 14 wherein a minimum value of the sufficient separation force is selected from a group consisting of: 0.5 pounds, two pounds.

16. The headphone of claim 13 wherein when an applied separation force that is less than the sufficient separation force is applied, the restraining mechanism is configured to restrain movement of the audio plug with respect to the audio output portion by a distance in a direction of insertion of the portion of the audio input portion selected from a group consisting of: less than 0.25 inches, 5 mm.

17. The headphone of claim 11 wherein the restraint mechanism is configured to restrain the portion of the audio input portion physically touching the audio output portion.

18. The headphone of claim 11 further comprising:

an in-line microphone positioned along one of the pair of wires, wherein the in-line microphone has an external perimeter;

wherein the restraint mechanism includes an internal opening having a perimeter greater to the perimeter of the in-line microphone; and wherein the restraint mechanism is configured to be positioned at a position above the in-line microphone and at a position below the in-line microphone.

19. The headphone of claim 11 wherein the restraint mechanism includes an internal opening;

wherein a perimeter of the internal opening of the restraint mechanism increases when the portion of the audio input portion is inserted into the restraint mechanism.

20. The headphone of claim 19 wherein an external shape of the restraint mechanism is not identical to a shape of the internal opening.

21. The headphone of claim 19 wherein the restraint mechanism includes at least one protrusion from an inner wall of the restraint mechanism and extending into the internal opening of the restraint mechanism.

22. The headphone of claim 11 wherein the restraint mechanism comprises a separate first portion and a second portion;

wherein the restraint mechanism comprises an internal opening having an internal perimeter;

wherein the audio input portion comprises a housing having an external perimeter; and wherein the external perimeter is larger than the internal perimeter.

23. A pair of headphones comprising:

an audio input jack configured to receive electrical audio signals;

a pair of ear buds configured to output audible audio signals in response to the electrical audio signals;

a pair of wires configured to electrically and physically couple the audio input jack to the pair of ear buds; and restraining means configured to restrain movement of a first ear bud relative to a second ear bud from the pair of ear buds, configured to restrain movement of the audio input jack relative to the pair of ear buds and configured to form a temporary and removable loop of wire from the pair of wires, when the audio input jack is inserted into the restraining means by the user, and wherein the restraining means is configured to not appreciably restrain movement of the first ear bud relative to the second ear bud from the pair of ear buds, configured to not appreciably restrain movement of the audio input jack relative to the pair of ear buds and configured to not form the temporary and removable loop of wire, when the audio input jack is removed from the restraining means by the user.

24. The pair of headphones of claim 23 wherein the pair of wires are disposed within at least one interior channel of the restraining means;

wherein the restraining means is configured to slide along the pair of wires; and wherein the audio input jack is selected from a group consisting of: a metal plug, a housing, and a strain-relief.

25. The pair of headphones of claim 23 wherein the restraining means comprises a body portion and at least one interior channel; and wherein the body portion includes an interior channel opening along a length of the body portion.

26. The pair of headphones of claim 25 wherein the interior channel opening is configured to allow a user to insert the pair of wires into the body portion to thereby dispose the pair of wires within the at least one interior channel of the restraining means.

27. The pair of headphones of claim 23 wherein the restraining means comprises a body portion and an interior channel; and wherein the interior channel is configured to allow a user to insert the audio input jack through the restraining means to thereby dispose the pair of wires within the at least one interior channel of the restraining means.

28. The method of claim 1 wherein the restraining mechanism comprises a body portion and a channel;

wherein the pair of wires are disposed within the channel; and wherein physically coupling the audio plug within the restraining mechanism comprises disposing at least a portion of the audio plug within the channel;

wherein the portion of the audio plug is selected from a group consisting of: a metal plug portion, a housing portion, and a strain-relief portion.

29. The method of claim 1 wherein the restraining mechanism comprises a body portion and a channel;

wherein the body portion includes a channel opening along a length of the body portion.

30. The method of claim 29 wherein the method further comprises:

receiving the restraining mechanism separate from the plurality of wires; and inserting the plurality of wires through the channel opening thereby disposing the plurality of wires within the channel of the restraining mechanism.

31. The method of claim 1 wherein the restraining mechanism comprises a body portion and a channel;

wherein the method further comprises:

receiving the plurality of wires;

receiving the restraining mechanism separate from the plurality of wires; and inserting the audio plug through the channel thereby disposing the plurality of wires within the channel of the restraining mechanism.

32. The headphone of claim 11 wherein the restraining mechanism comprises a body portion and an interior channel;

wherein the plurality of wires are disposed within the interior channel; and wherein the portion of the audio input portion is selected from a group consisting of: a metal plug portion, a housing portion, and a strain-relief portion.

33. The headphone of claim 11 wherein the restraint mechanism comprises a body portion and an interior channel;

wherein the body portion includes an interior channel opening along a length of the body portion.

34. The headphone of claim 33 wherein the interior channel opening is configured to allow a user to insert the plurality of wires into the body portion to thereby dispose the plurality of wires within the interior channel of the restraint mechanism.

35. The headphone of claim 11 wherein the restraint mechanism comprises a body portion and an interior channel; and wherein the interior channel is configured to allow a user to insert the audio input portion through the restraint mechanism to thereby dispose the plurality of wires within the interior channel of the restraint mechanism.

* * * * *